US009053701B2

(12) United States Patent
Oshikiri

(10) Patent No.: US 9,053,701 B2
(45) Date of Patent: Jun. 9, 2015

(54) CHANNEL SIGNAL GENERATION DEVICE, ACOUSTIC SIGNAL ENCODING DEVICE, ACOUSTIC SIGNAL DECODING DEVICE, ACOUSTIC SIGNAL ENCODING METHOD, AND ACOUSTIC SIGNAL DECODING METHOD

(75) Inventor: Masahiro Oshikiri, Kanagawa (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 862 days.

(21) Appl. No.: 13/203,449

(22) PCT Filed: Feb. 25, 2010

(86) PCT No.: PCT/JP2010/001301

§ 371 (c)(1),
(2), (4) Date: Aug. 25, 2011

(87) PCT Pub. No.: WO2010/098120

PCT Pub. Date: Sep. 2, 2010

(65) Prior Publication Data

US 2011/0311061 A1 Dec. 22, 2011

(30) Foreign Application Priority Data

Feb. 26, 2009 (JP) ..... 2009-044806

(51) Int. Cl.
*G10L 19/008* (2013.01)
*H04S 1/00* (2006.01)

(52) U.S. Cl.
CPC ..... *G10L 19/008* (2013.01); *H04S 1/007* (2013.01); *H04S 2420/03* (2013.01); *H04S 2420/07* (2013.01)

(58) Field of Classification Search
CPC .... G10L 19/008; H04S 1/007; H04S 2420/03
USPC ..... 381/1, 17, 22, 23, 20, 18; 704/500–504, 704/203, 216, 219; 700/94
See application file for complete search history.

(56) References Cited

U.S. PATENT DOCUMENTS 8,255,228 B2 * 8/2012 Hilpert et al. ..... 704/500
8,346,379 B2 * 1/2013 Lee et al. ..... 700/94

(Continued)

FOREIGN PATENT DOCUMENTS

JP 2004-535145 11/2004
JP 2005-218003 8/2005

(Continued)

OTHER PUBLICATIONS

Supplementary European Search Report dated May 15, 2013.

(Continued)

*Primary Examiner* — Vivian Chin
*Assistant Examiner* — David Ton
(74) *Attorney, Agent, or Firm* — Dickinson Wright PLLC

(57) ABSTRACT

Provided is a channel signal generation device capable of avoiding a decrease in the prediction performance for predicting an L channel signal and an R channel signal from a monaural signal and achieving encoding with high sound quality. In the device, a monaural MDCT coefficient corrector (301) generates a left channel change monaural MDCT coefficient and a right channel change monaural MDCT coefficient using a decoding monaural MDCT coefficient generated using a left channel signal and a right channel signal, which constitute an acoustic signal. More specifically, the monaural MDCT coefficient corrector (301) generates the left channel change monaural MDCT coefficient and the right channel change monaural MDCT coefficient by performing change processing for compensating for the phase difference between the left channel signal and the right channel signal on the decoding monaural MDCT coefficient according to inputted determination data.

11 Claims, 15 Drawing Sheets

(56) References Cited

U.S. PATENT DOCUMENTS

| | | | | |
|---|---|---|---|---|
| 2005/0053242 | A1 | 3/2005 | Henn | |
| 2005/0177360 | A1 | 8/2005 | Schuijers | |
| 2006/0147048 | A1 | 7/2006 | Breebaart | |
| 2007/0127729 | A1 | 6/2007 | Breebaart | |
| 2008/0046253 | A1 * | 2/2008 | Vinton et al. | 704/503 |
| 2008/0091419 | A1 | 4/2008 | Yoshida | |
| 2009/0055169 | A1 | 2/2009 | Goto | |
| 2009/0076809 | A1 | 3/2009 | Yoshida | |
| 2011/0235810 | A1 * | 9/2011 | Neusinger et al. | 381/23 |

FOREIGN PATENT DOCUMENTS

| | | |
|---|---|---|
| JP | 2005-533271 | 11/2005 |
| JP | 2006-518482 | 8/2006 |
| JP | 2006-323314 | 11/2006 |
| WO | 2006/003813 | 1/2006 |
| WO | 2006/080358 | 8/2006 |
| WO | 2006/118178 | 11/2006 |
| WO | 2007/074401 | 7/2007 |

OTHER PUBLICATIONS

J, Breebaart, et al., "Parametric Coding of Stereo Audio," EURASIP Journal on Applied Signal Processing, XP-002514252, Sep. 1, 2005, pp. 1305-1322.

A. Biswas, "Advances in Perceptual Stereo Audio Coding Using Linear Prediction Techniques," XP-055061323, May 15, 2007, pp. i-xviii and 1-180.

International Search Report dated Mar. 30, 2010.

V. Pulkki, et al., "Localization of Amplitude-Panned Virtual Sources I: Stereophonic Panning," Journal of the Audio Engineering Society, vol. 49, No. 9, Sep. 9, 2001, pp. 739-752, p. 2, Line 20.

B. Cheng, et al., "Principles and Analysis of the Squeezing Approach to Low Bit Rate Spatial Audio Coding," IEEE International Conference on Acoustics, Speech and Signal Processing, Apr. 2007, pp. I-13-I-16, p. 2, Line 24.

* cited by examiner

CHANNEL SIGNAL GENERATION DEVICE, ACOUSTIC SIGNAL ENCODING DEVICE, ACOUSTIC SIGNAL DECODING DEVICE, ACOUSTIC SIGNAL ENCODING METHOD, AND ACOUSTIC SIGNAL DECODING METHOD

TECHNICAL FIELD

The present invention relates to, in particular, a channel signal generation apparatus, an acoustic signal encoding apparatus using a monaural signal to generate an L-channel signal (left-channel signal) and an R-channel signal (right-channel signal), an acoustic signal decoding apparatus, an acoustic signal encoding method, and an acoustic signal decoding method.

BACKGROUND ART

In a mobile communications system, for an effective use of a radio wave resource or the like, an audio signal is required to be compressed to a low bit rate and transmitted. On the other hand, an increase in quality of a call voice and realization of the realistic high call service are also desired. To the realization, it is desirable to code not only a monaural signal but a multi channel acoustic signal, especially a stereo sound signal with high quality.

As a system for encoding a stereo sound signal with a low bit rate, an intensity stereo system has been known. The intensity stereo system employs a technique of multiplying a monaural signal by a scaling factor and generating an L-channel signal and an R-channel signal. Such a technique is also referred to as an amplitude panning.

The most fundamental technique of the amplitude panning is to multiply a monaural signal in a time domain by a gain coefficient for amplitude panning (panning gain coefficient) to obtain an L-channel signal and an R-channel signal (see, for example, non-patent literature 1). As another technique, in a frequency domain, a monophonic signal is multiplied by a panning gain coefficient for each frequency component or for each frequency group to obtain an L-channel signal and an R-channel signal (see, for example, non-patent literature 2).

If a panning gain coefficient is used as an encoding parameter of a parametric stereo, scalable encoding of a stereo signal (monophonic stereo scalable coding) is realizable (see, for example, patent literature 1 and patent literature 2). The panning gain coefficient is described as a balance parameter in a patent literature 1 and ILD (level difference) in patent literature 2, respectively.

When converting an acoustic signal into a frequency domain, generally a modified discrete cosine transform (hereinafter, described as "MDCT") is used in consideration of characteristics of high conversion efficiency and difficulty in generation of high frame boundary distortion.

CITATION LIST

Non-Patent Literature

NPL 1

V. Pulkki and M. Karjalainen, "Localization of amplitude-panned virtual sources I: Stereophonic panning", Journal of the Audio Engineering Society, pp. 739-752, Vol. 49, No. 9, Sep. 9, 2001

NPL 2

B. Cheng, C. Ritz, and I. Burnett, "Principles and analysis of the squeezing approach to low bit rate spatial audio coding" proc. IEEE ICASS P2007, pp. I-13-I-16, April, 2007

Patent Literature

PTL 1

Japanese Patent Application National Publication No. 2004-535145;

PTL 2

Japanese Patent Application National Publication No. 2005-533271;

SUMMARY OF INVENTION

Technical Problem

However, in the conventional apparatus, the technique for predicting an L-channel signal and an R-channel signal by using MDCT for frequency domain transform and multiplying a monaural signal by a balance parameter has a problem in that a significant reduction in performance of predicting an L-channel signal and an R-channel signal occurs when a phase difference is present between the L-channel signal and the R-channel signal.

This is due to the characteristics of MDCT described below. That is, MDCT has advantages of high conversion efficiency and difficulty in generation of frame boundary distortion as described above, while having a characteristic of generating a large difference in calculated MDCT coefficients due to a difference in phase of analytical target waveforms. An example of this characteristic is described with reference to FIG. 1 and FIG. 2. FIG. 1 is a diagram illustrating two sine curves of different phases at a frequency of 1 kHz. FIG. 2 is a diagram illustrating MDCT coefficients calculated by performing MDCT on the since curves of FIG. 1, respectively. In FIG. 1, a sold line represents sine curve 1 and a dashed line represents sine wave 2. In FIG. 2 a solid line represents MDCT coefficients 1 calculated by performing MDCT on sine curve 1 of FIG. 1 and a dashed line represents MDCT coefficients 2 calculated by performing MDCT on sine curve 2 of FIG. 1.

As is evident from FIG. 1 and FIG. 2, MDCT coefficients having large energies are obtained from the waveforms of sine curve 1 and sine curve 2 at a frequency of about 1 kHz, respectively. However, sine curve 1 and sine curve 2 have different phases. As illustrated in FIG. 2, therefore, the calculated values of MDCT coefficients are significantly different from each other. In other words, MDCT may be a conversion method which is sensitive to a phase difference.

Such a characteristic of MDCT has a problem in that performance of predicting an L-channel signal and an R-channel signal from a monaural signal decreases significantly when a phase difference between the L-channel signal and the R-channel signal occurs.

An object present invention is to provide a channel signal generation apparatus, acoustic signal encoding apparatus, acoustic signal decoding apparatus, an acoustic signal encoding method, and an acoustic signal decoding method, which can avoid a decrease in performance of predicting an L-channel signal and an R-channel signal from a monaural signal, and realize high-quality sound encoding.

Solution to Problem

A channel signal generation apparatus according to the present invention is one for generating a frequency domain first channel signal for the first channel and a frequency domain second channel signal for the second channel by using a frequency domain monaural signal generated by using a first stereo signal for a first channel and a second stereo signal for a second channel, which constitute an acoustic signal, the generation apparatus having: a generation section that generates the frequency domain first channel signal and the frequency domain second channel signal by performing change processing on the frequency domain monaural signal, where the change processing compensates for the phase difference between the first stereo signal and the second stereo signal in accordance with input determination data.

An acoustic signal encoding apparatus according to the present invention is one for generating a stereo encoded data using a frequency domain monaural signal generated by using a first stereo signal for a first channel and a second stereo signal for a second channel, including: the aforementioned channel signal generation apparatus; a prediction section that performs prediction processing using the frequency domain first channel signal and the frequency domain second channel signal, which are generated by the channel signal generation apparatus, to generate a first channel prediction candidate signal for the first channel and a second channel prediction candidate signal for the second channel; and an encoding section that selects one from a plurality of first channel prediction candidate signals and determines the selected one as a first channel prediction signal, selects one from a plurality of second channel prediction candidate signals and determines the selected one as a second channel prediction signal, and performs encoding using a first error signal, which is an error between the first channel prediction signal and a frequency domain first stereo signal generated by frequency domain transform of the first stereo signal, and a second error signal, which is an error between the second channel prediction signal and a frequency domain second stereo signal generated by frequency domain transform of the second stereo signal.

An acoustic signal encoding apparatus according to the present invention is one for generating a stereo encoded data using a frequency domain monaural signal generated by using a first stereo signal for a first channel and a second stereo signal for a second channel, including: a prediction section that subjects the frequency domain monaural signal to prediction processing using the first balance parameter candidate of the first channel and the second balance parameter candidate of the second channel to generate a first channel prediction candidate signal of the first channel and a second channel prediction candidate signal; the aforementioned channel signal generation apparatus; and an encoding section that performs encoding using a first error signal and a second error signal, where the first error signal is an error between a frequency domain first stereo signal generated by performing frequency domain transform of the first stereo signal and the frequency domain first channel signal, and the second error signal is an error between a frequency domain second stereo signal generated by performing frequency domain transform of the second stereo signal and the frequency domain second channel signal.

An acoustic signal decoding apparatus according to the present invention is one for receiving and decoding stereo encoded data generated by encoding with a frequency domain first monaural signal generated by a first stereo signal for a first channel and a second stereo signal for a second channel in an acoustic signal decoding apparatus, including: a reception section that takes out and outputs balance parameter encoded data from the stereo encoded data: a generation section that performs change processing for compensating a phase difference between the first stereo signal and the second stereo signal on an input frequency domain second monaural signal to generate a frequency domain first channel signal for the first channel and a frequency domain second channel signal for the second channel in accordance with input determination data; a prediction section that performs prediction processing that applies a balance parameter obtained using the balance parameter encoded data to the frequency domain first channel signal and the frequency domain second channel signal to generate a first channel prediction signal of the first channel and a second channel prediction signal of the second channel; and decoding section that performs decoding using the first channel prediction signal and the second channel prediction signal.

An acoustic signal encoding method according to the present invention is one for generating a stereo encoded data using a frequency domain monaural signal generated by using a first stereo signal for a first channel and a second stereo signal for a second channel, including the steps of: generating a frequency domain first channel signal and a frequency domain second channel signal by performing change processing on the frequency domain monaural signal, where the change processing compensates for the phase difference between the first stereo signal and the second stereo signal in accordance with input determination data (generation step); performing prediction processing using the frequency domain first channel signal and the frequency domain second channel signal to generate a first channel prediction candidate signal for the first channel and a second channel prediction candidate signal for the second channel (prediction step); and selecting one from a plurality of first channel prediction candidate signals and determining the selected one as a first channel prediction signal, selecting one from a plurality of second channel prediction candidate signals and determining the selected one as a second channel prediction signal, performing encoding using a first error signal and a second error signal, where the first error signal is an error between the first channel prediction signal and a frequency domain first stereo signal generated by frequency domain transform of the first stereo signal, and a second error signal is an error between the second channel prediction signal and a frequency domain second stereo signal generated by frequency domain transform of the second stereo signal (encoding step).

A method for decoding an acoustic signal according to the present invention is one for decoding an acoustic signal by receiving stereo encoded data generated by encoding with a frequency domain first monaural signal generated by a first stereo signal for a first channel and a second stereo signal for a second channel in an acoustic signal decoding apparatus, including: taking out and outputting a balance parameter encoded data from the stereo encoded data (receiving step): generating a frequency domain first channel signal and a frequency domain second channel signal by performing change processing on the frequency domain monaural signal, where the change processing compensates for the phase difference between the first stereo signal and the second stereo signal in accordance with input determination data (generation step); performing prediction processing for applying a balance parameter obtained by using the balance parameter encoded data to the frequency domain first channel signal and the frequency domain second channel signal to generate a first prediction signal of the first channel and a second channel prediction signal of the second channel (prediction step); and performing decoding using the first channel prediction signal and the second channel prediction signal (decoding step).

Advantageous Effects of Invention

According to the present invention, the prediction performance degradation which predicts L-channel signaling and R-channel signaling from a monophonic signal can be avoided, and high-quality sound coding can be realized.

DESCRIPTION OF EMBODIMENTS

Hereafter, embodiments of the present invention will be described in detail with reference to the drawings.

Embodiment 1

Figure 1:
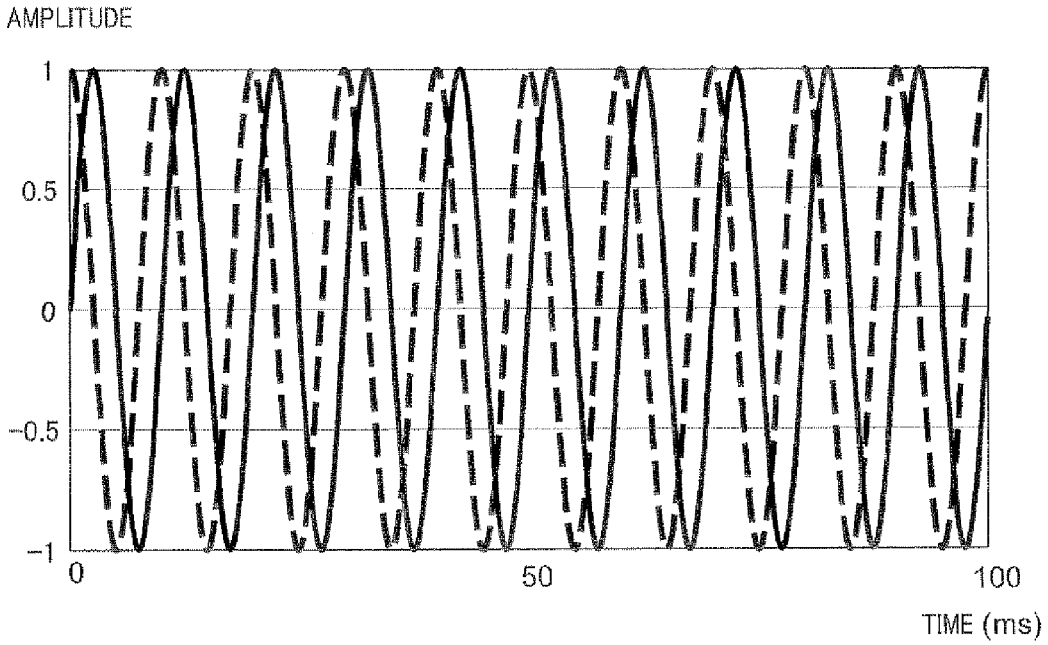
FIG. 1 is a diagram illustrating two sine curves of different phases at a frequency of 1 kHz.
Figure 2:
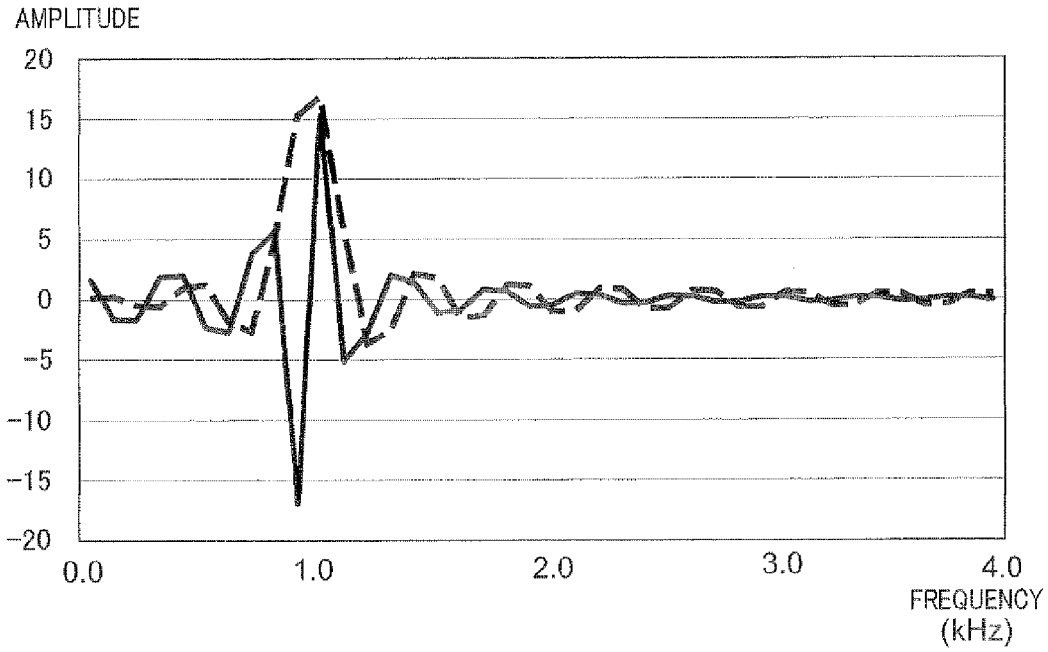
FIG. 2 is a diagram illustrating MDCT coefficients obtained by performing MDCT on the sine waves of FIG. 1.
Figure 3:
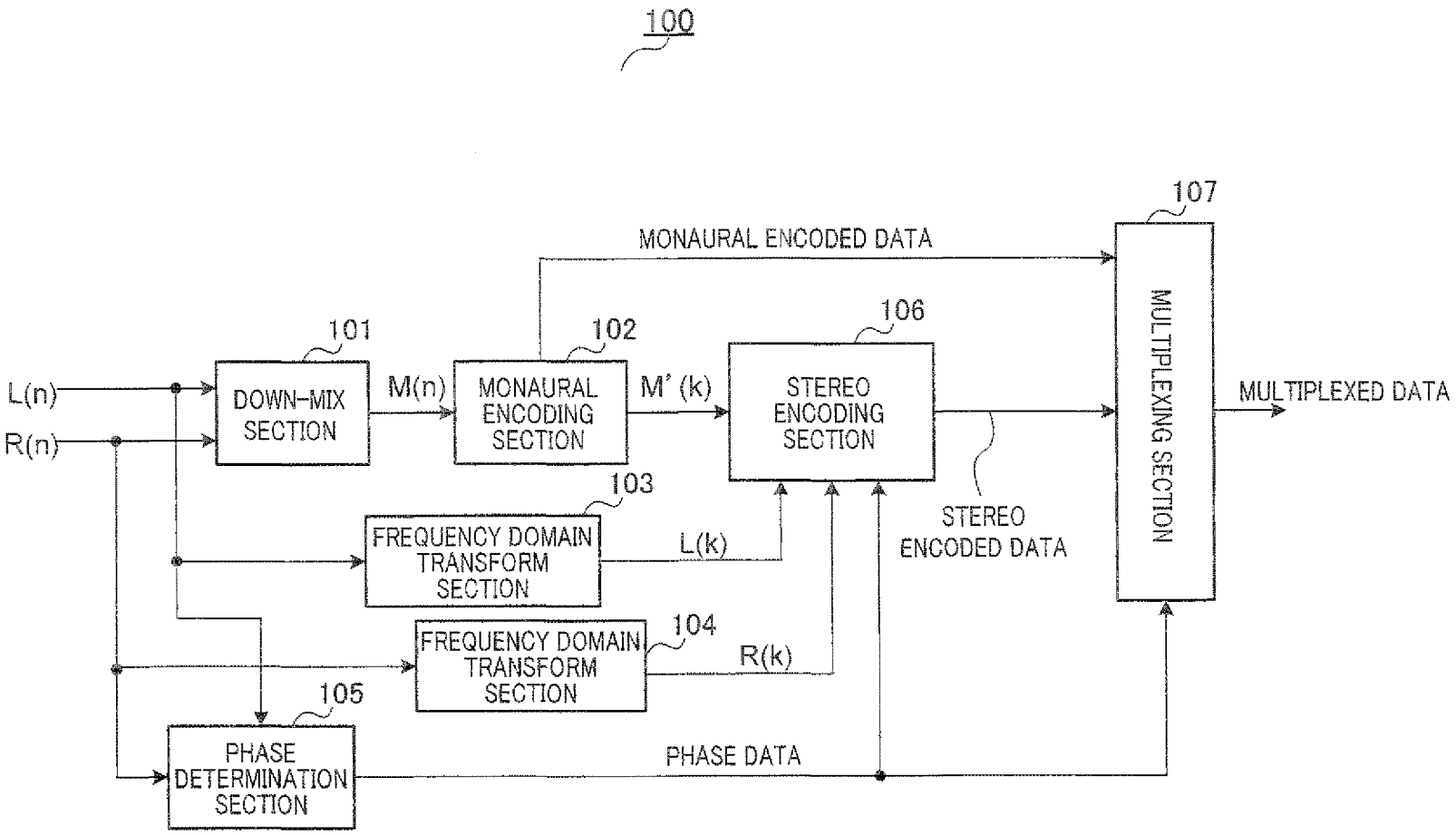
FIG. 3 is a block diagram illustrating the configuration of an acoustic signal transmitting apparatus according to Embodiment 1 of the present invention.

FIG. 3 is a block diagram illustrating the configuration of acoustic signal transmitting apparatus 100 according to Embodiment 1 of the present invention.

Acoustic signal transmitting apparatus 100 mainly includes down-mix section 101, monaural encoding section 102, frequency domain transform section 103, frequency domain transform section 104, phase determination section 105, stereo encoding section 106, and multiplexing section 107. Hereinafter, each configuration will be described in detail.

Down mix section 101 performs down mix processing of a stereo signal that includes an L-channel signal (L(n)) and an R-channel signal (R(n)), and generates a monaural signal (M(n)). Then, down-mix section 101 outputs the generated monaural signal to monaural encoding section 102.

Monaural encoding section 102 encodes the monaural signal input from down-mix section 101, and outputs the monaural encoded data as a result of the encoding to multiplexing section 107. Monaural encoding section 102 outputs decoded monaural MDCT coefficients (M'(k)) obtained by encoding processing of the monaural signal input from down-mix section 101 to stereo encoding section 106.

Frequency domain transform section 103 calculates a spectrum (L(k)) by performing frequency domain transform that converts the input L-channel signal into a frequency domain signal from a time domain signal. Then, frequency domain transform section 103 outputs the calculated spectrum to stereo encoding section 106. Here, MDCT is used for frequency domain transform. Therefore, the spectrum obtained in frequency domain transform section 103 is L-channel MDCT coefficients. Hereinafter, the frequency domain transform will be described as one that uses MDCT.

Frequency domain transform section 104 calculates R-channel MDCT coefficients (R(k)) by performing frequency domain transform of an input R-channel signal. Then, frequency domain transform section 104 outputs the calculated R-channel MDCT coefficients to stereo encoding section 106.

Phase determination section 105 calculates a phase difference which is a time lag of an L-channel signal and an R-channel signal by performing a correlation analysis for the correlation between an input R-channel signal and an input L-channel signal. Then, phase determination section 105 is output to stereo encoding section 106 and multiplexing section 107 by using the calculated phase difference as calculated phase data.

Stereo encoding section 106 uses decoded monaural MDCT coefficients input from monaural encoding section 102 and phase data input from phase determination section 105 to encode L-channel MDCT coefficients input from frequency domain transform section 103 and R-channel MDCT coefficients input from frequency domain transform section 104. Balance parameter encoded data is generated. Furthermore, stereo encoding section 106 outputs stereo encoded data that contains the generated balance parameter encoded data and the like to multiplexing section 107. Here, the details of the configuration of stereo encoding section 106 will be described later.

Multiplexing section 107 generates multiplexed data by multiplexing the monaural encoded data input from monaural encoding section 102, the stereo encoded data input from stereo encoding section 106, and the phase data input from phase determination section 105. Then, multiplexing section 107 outputs the generated multiplexed data to a communication path (not illustrated).

Now, the description of the configuration of acoustic signal transmitting apparatus 100 is finished.

Figure 4:
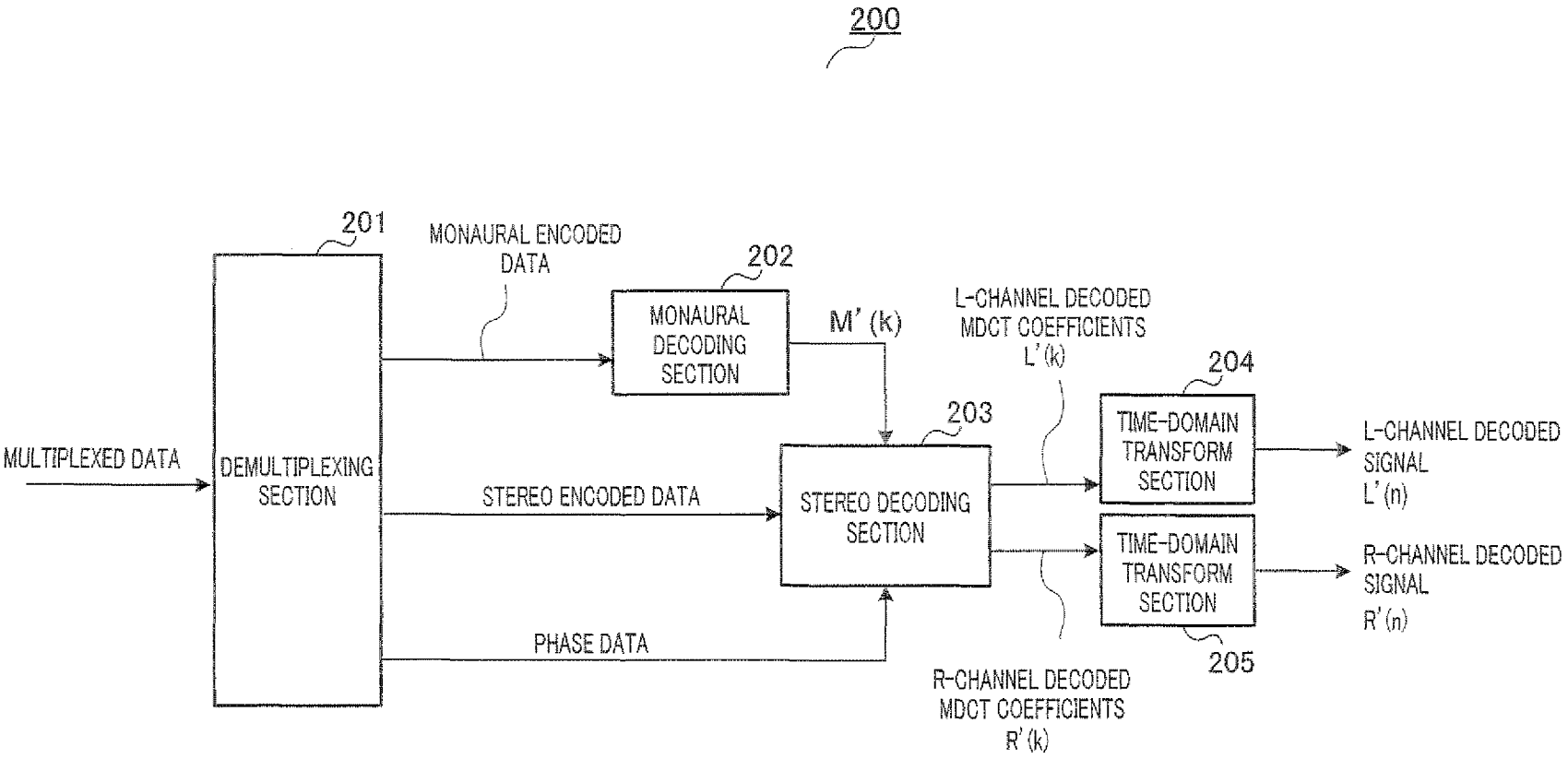
FIG. 4 is a block diagram illustrating the configuration of an acoustic signal receiving apparatus according to Embodiment 1 of the present invention.

Next, acoustic signal receiving apparatus 200 according to the present embodiment will be described with reference to FIG. 4. FIG. 4 is a block diagram illustrating the configuration of acoustic signal receiving apparatus 200.

Acoustic signal receiving apparatus 200 mainly includes demultiplexing section 201, monaural decoding section 202, stereo decoding section 203, time-domain transform section 204, and time-domain transform section 205. Hereinafter, each configuration will be described in detail.

Demultiplexing section 201 receives multiplexed data sent out from acoustic signal transmitting apparatus 100. Demultiplexing section 201 divides the received multiplexed data into monaural encoded data, stereo encoded data, and phase data. Then, demultiplexing section 201 outputs monaural encoded data to monaural decoding section 202, and outputs stereo encoded data and phase data to stereo decoding section 203.

Monaural decoding section 202 decodes a monaural signal using the monaural encoded data input from demultiplexing section 201, and outputs the decoded monaural MDCT coefficients (M'(k)), which are MDCT coefficients of a decoding monaural signal, to stereo decoding section 203.

Stereo decoding section 203 calculates L-channel decoded MDCT coefficients (L'(k)) and R-channel decoded. MDCT coefficients (R'(k)) by using decoded monaural MDCT coefficients input from monaural decoding section 202 and stereo encoded data and phase data which are input from demultiplexing section 201. Then stereo decoding section 203 outputs the calculated R-channel decoded MDCT coefficients to time-domain transform section 205, while outputting the calculated L-channel decoded MDCT coefficients to time-domain transform section 204. Here, the details of the configuration of stereo decoding section 203 will be described later.

Time-domain transform section 204 converts the L-channel decoded MDCT coefficients input from stereo decoding section 203 into a time domain signal from a frequency domain signal to acquire an L-channel decoded signal (L'(n)), and outputs the acquired L-channel decoded signal.

Time-domain transform section 205 converts the R-channel decoded MDCT coefficients input from stereo decoding section 203 into a time domain signal from a frequency domain signal to acquire an R-channel decoded signal (R'(n)), and outputs the acquired R-channel decoded signal.

Now the description of the configuration of acoustic signal receiving apparatus 200 is finished.

Figure 5:
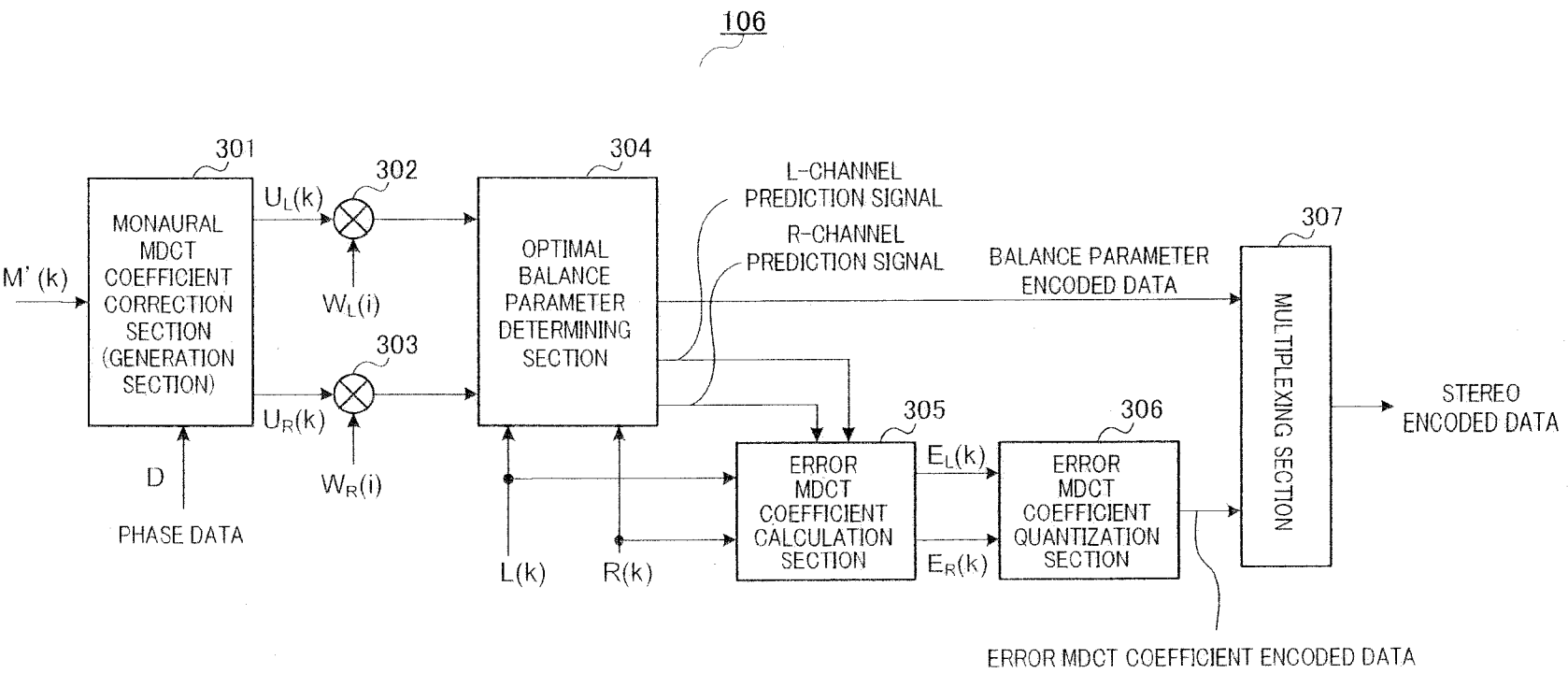
FIG. 5 is a block diagram illustrating the configuration of a stereo encoding section according to Embodiment 1 of the present invention.

Next, the configuration of stereo encoding section 106 will be described with reference to FIG. 5. FIG. 5 is a block diagram illustrating the configuration of stereo encoding section 106. Stereo encoding section 106 has a basic function as acoustic signal encoding apparatus.

Stereo encoding section 106 mainly includes monaural MDCT coefficient correction section 301, multiplier 302, multiplier 303, optimal balance parameter determining section 304, error MDCT coefficient calculation section 305, error MDCT coefficient quantization section 306, and multiplexing section 307. Hereinafter, each configuration will be described in detail.

Based on the phase data input from phase determination section 105, monaural MDCT coefficient correction section 301, adds processing of adjusting so that the phase difference of an L-channel signal and an R-channel signal may be compensated to the decoded monaural MDCT coefficients input from monaural encoding section 102 to generate an L-channel changing monaural MDCT coefficients ($U_L(k)$) and R-channel changing monaural MDCT coefficients ($U_R(k)$). That is, monaural MDCT coefficient correction section 301 has the function of changing decoded monaural MDCT coefficients into L-channel changing monaural MDCT coefficients and R-channel changing monaural MDCT coefficients. Then, monaural MDCT coefficient correction section 301 outputs the generated R-channel changing monaural MDCT coefficients to multiplier 303, while outputting the generated L-channel changing monaural MDCT coefficients to multiplier 302. A concrete method for generating L-channel changing monaural MDCT coefficients and R-channel changing monaural MDCT coefficients in monaural MDCT coefficient correction section 301 will be described later.

Multiplier 302 outputs the candidate of an L-channel prediction signal to optimal balance parameter determining section 304. Here, the L-channel prediction signal is a result ($U_L(k)\cdot W_L(i)$) of multiplying L-channel changing monaural MDCT coefficients input from monaural MDCT coefficient correction section 301 by the "i" ("i" is an integer of 2 or larger) candidate of balance parameter ($W_L(i)$).

Multiplier 303 outputs the candidate of an R-channel prediction signal to optimal balance parameter determining section 304. Here, the R-channel prediction signal is a result ($U_R(k)\cdot W_R(i)$) of multiplying R-channel changing monaural MDCT coefficients input from monaural MDCT coefficient correction section 301 by the "i" candidate of balance parameter ($W_R(i)$).

Optimal balance parameter determining section 304 calculates a difference between the candidate of an L-channel prediction signal and the L-channel MDCT coefficients input from frequency domain transform section 103. In addition, optimal balance parameter determining section 304 calculates a difference between the candidate of an R-channel prediction signal and the R-channel. MDCT coefficients input from frequency domain transform section 104. Furthermore, optimal balance parameter determining section 304 determines a balance parameter ($W_L(i_{opt})$, $W_R(i_{opt})$) when the sum of both differences becomes the smallest. The candidates of the prediction signals of L-channel and R-channel serve as prediction signals of L-channel and R-channel, respectively. Then, the optimal balance parameter determining section 304 encodes an index that specifies the determined balance parameter, and outputs it to multiplexing section 307 as balance parameter encoded data. Here, $i_{opt}$ is an index that specifies the optimal balance parameter. Further, optimal balance parameter determining section 304 outputs an L-channel prediction signal and an R-channel prediction signal to error MDCT coefficient calculation section 305.

Error MDCT coefficient calculation section 305 subtracts the L-channel prediction signal input from optimal balance parameter determining section 304 from the L-channel MDCT coefficients input from frequency domain transform section 103 to obtain an L-channel error MDCT coefficients ($E_L(k)$). Error MDCT coefficient calculation section 305 subtracts the R-channel prediction signal input from optimal balance parameter determining section 304 from the R-channel MDCT coefficients input from frequency domain transform section 104 to obtain R-channel error MDCT coefficients ($E_R(k)$). Then, error MDCT coefficient calculation section 305 outputs the obtained L-channel error MDCT coefficients and the obtained R-channel error MDCT coefficients to error MDCT coefficient quantization section 306.

Error MDCT coefficient quantization section 306 quantizes the L-channel error MDCT coefficients and the R-channel error MDCT coefficients, which are input from error MDCT coefficient calculation section 305, to obtain error MDCT coefficient encoded data. Then, error MDCT coefficient quantization section 306 outputs the obtained error MDCT coefficient encoded data to multiplexing section 307.

Multiplexing section 307 multiplexes the balance parameter encoded data input from optimal balance parameter determining section 304 and the error MDCT coefficient encoded data input from error MDCT coefficient quantization section 306, and outputs them to multiplexing section 107 as stereo encoded data. Multiplexing section 307 is not essential to this embodiment. Optimal balance parameter determining section 304 carries out the direct output of the balance parameter encoded data to multiplexing section 107, while error MDCT coefficient quantization section 306 may directly output the error MDCT coefficient encoded data to multiplexing section 107.

Now, the description of the configuration of stereo encoding section 106 is finished.

Figure 6:
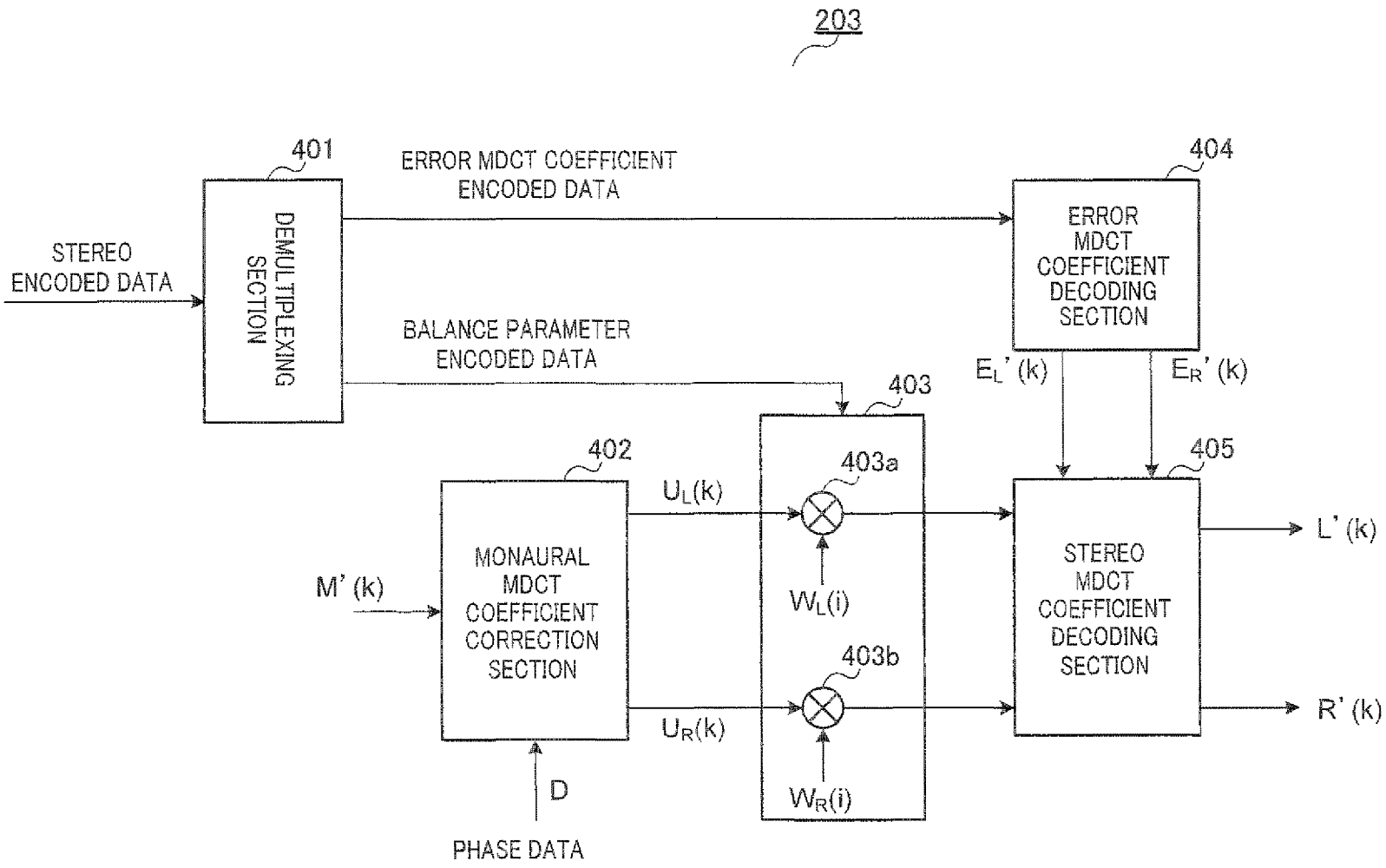
FIG. 6 is a block diagram illustrating the configuration of a stereo decoding section according to Embodiment 1 of the present invention.

Next, the configuration of stereo decoding section 203 will be described with reference to FIG. 6. FIG. 6 is a block diagram that illustrates the configuration of stereo decoding section 203. Stereo decoding section 203 has a basic function as acoustic signal decoding apparatus.

Stereo decoding section 203 mainly includes demultiplexing section 401, monaural MDCT coefficient correction section 402, multiplying section 403, error MDCT coefficient decoding section 404, and stereo MDCT coefficient decoding section 405. Hereinafter, each configuration will be described in detail.

Demultiplexing section 401 divides the stereo encoded data input from demultiplexing section 201 into balance parameter encoded data and error MDCT coefficient encoded data. Then, demultiplexing section 401 outputs the error MDCT coefficient encoded data to error MDCT coefficient decoding section 404 while outputting the balance parameter encoded data to multiplying section 403. Demultiplexing section 401 is not essential to this embodiment. Demultiplexing section 201 may separate the data into balance parameter encoded data and error MDCT coefficient encoded data, and directly output balance parameter encoded data to multiplying section 403, while directly outputting the error MDCT coefficient encoded data to error MDCT coefficient decoding section 404.

Monaural MDCT coefficient correction section 402 performs the same processing as the change processing performed on the encoding apparatus side. The change processing compensates the phase difference between an L-channel signal and an R-channel signal to decoded monaural MDCT coefficients. That is, monaural MDCT coefficient correction section 402 chooses the modified matrix of one set, a combination of L-channel and R-channel, from a plurality of modified matrices which are previously designed and stored based on the phase data input from demultiplexing section 201. Then, monaural MDCT coefficient correction section 402 changes the decoded monaural MDCT coefficients input from monaural decoding section 202 by using the selected modified matrix. Thus, L-channel changing monaural MDCT coefficients ($U_L(k)$) and R-channel changing monaural MDCT coefficients ($U_R(k)$) are generated. Subsequently, monaural MDCT coefficient correction section 402 outputs the generated L-channel changing monaural MDCT coefficients and the generated R-channel changing monaural MDCT coefficients to multiplying section 403.

In multiplier 403*a*, multiplying section 403 multiplies the L-channel changing monaural MDCT coefficients input from monaural MDCT coefficient correction section 402 by the optimal balance parameter ($W_L(i_{opt})$) specified by balance parameter encoded data input from demultiplexing section 401 to obtain a multiplication result ($W_L(i_{opt})\cdot U_L(k)$) (i.e. an L-channel prediction signal). In multiplier 403*b*, multiplying section 403 multiplies the R-channel changing monaural MDCT coefficients input from monaural MDCT coefficient correction section 402 by the optimal balance parameter ($W_R(i_{opt})$) specified by balance parameter encoded data input from demultiplexing section 401 to obtain a multiplication result ($W_R(i_{opt})\cdot U_R(k)$) (i.e. an R-channel prediction signal). Subsequently, multiplying section 403 outputs each acquired multiplication result to stereo MDCT coefficient decoding section 405.

Using the error MDCT coefficient encoded data input from demultiplexing section 401, error MDCT coefficient decoding section 404 decodes L-channel error MDCT coefficients and outputs a decoding result ($E_L'(k)$) to stereo MDCT coefficient decoding section 405. Using the error MDCT coefficient encoded data input from demultiplexing section 401, error MDCT coefficient decoding section 404 decodes R-channel error MDCT coefficients and outputs a decoding result (ER'(k)) to stereo MDCT coefficient decoding section 405.

Stereo MDCT coefficient decoding section 405 adds the decoding result of the L-channel error MDCT coefficients input from error MDCT coefficient decoding section 404 to the L-channel prediction signal input from multiplier 403*a* of multiplying section 403 to obtain L-channel decoded MDCT coefficients (L'(k)). The calculated L-channel decoded MDCT coefficients are output. In addition, stereo MDCT coefficient decoding section 405 adds the decoding result of the R-channel error MDCT coefficients input from error MDCT coefficient decoding section 404 to the R-channel prediction signal input from multiplier 403*b* of multiplying section 403 to obtain R-channel decoded MDCT coefficients (R'(k)). The calculated R-channel decoded MDCT coefficients are output.

Now, the description of the configuration of stereo decoding section 203 is finished.

Next a concrete method for generating L-channel changing monaural MDCT coefficients and R-channel changing monaural MDCT coefficients in monaural MDCT coefficient correction section 301 will be described.

Monaural MDCT coefficient correction section 301 stores a plurality of modified matrices which are previously designed. Then, monaural MDCT coefficient correction section 301 chooses one-set modified matrix including an L-channel and an R-channel using the phase data given from phase determination section 105 and changes decoded monaural MDCT coefficients according to equation 1. Thus, L-channel changing monaural. MDCT coefficients ($U_L(k)$) and R-channel changing monaural MDCT coefficients ($U_R(k)$) are generated.

Equation 1

$$U_L(k) = \sum_{j=0}^{K-1} h_L(k, j)\cdot M'(j) \quad (k = 0, \ldots, K-1) \qquad [1]$$

$$U_R(k) = \sum_{j=0}^{K-1} h_R(k, j)\cdot M'(j) \quad (k = 0, \ldots, K-1)$$

Here, $h_L(k,j)$ and $h_R(k,j)$ are L-channel modified matrix and R-channel modified matrix, respectively.

Here, as a design method for L-channel modified matrix and R-channel modified matrix, for example, L-channel signals and R-channel signals of various phase differences are prepared. In addition, monaural signals; which are obtained from L-channel signals and R-channel signals; L-channel signals; and R-channel signals are provided as MDCTs, respectively. Then, the variation of an L-channel MDCT conversion factor to a monaural MDCT conversion factor is equalized to obtain an L-channel modified matrix. Similarly, the variation of an R-channel MDCT conversion factor to a monophonic MDCT conversion factor is equalized to obtain an R-channel modified matrix. Then, the modified matrices for L-channels and the modified matrices for R-channels are designed to various phase differences D by the design method as described above.

Monaural MDCT coefficient correction section 301 chooses one set of modified matrices according to the phase data given from phase determination section 105 among a plurality of modified matrices which are previously designed as described above and uses it for change of decoded monaural MDCT coefficients.

Thus, according to the present embodiment, an L-channel signal and an R-channel signal are predicted using the monaural signal corrected according to the phase difference between the L-channel signal and the R-channel signal. Therefore, from a monaural signal, it is possible to avoid a decrease in performance of predicting an L-channel signal and an R-channel signal. Thus, high-quality sound encoding can be realized.

In this embodiment, encoding is performed using L-channel changing monaural MDCT coefficients and R-channel changing monaural MDCT coefficients, but the present embodiment is not limited thereto. Alternatively, the processing of changing monaural MDCT coefficients may be performed only a channel on the one side. In this case, the energy of L-channel MDCT coefficients and the energy of R-channel MDCT coefficients are compared, and the monaural MDCT coefficients changed for the channel of lower energy are used. This is based on the following reason.

The channel of lower energy shows a larger variation in MDCT coefficients due to a phase difference than that of the channel of higher energy. In other words, the channel of lower energy tends to be affected by the phase difference rather than the channel of higher energy. Therefore, the channel of lower energy is selected. Then, only the selected channel of lower energy is subjected to a process of changing monaural MDCT coefficients. As a result, the size of calculation and the size of memory can be prevented from increasing while the effects of the present embodiment are retained.

Embodiment 2

Figure 7:
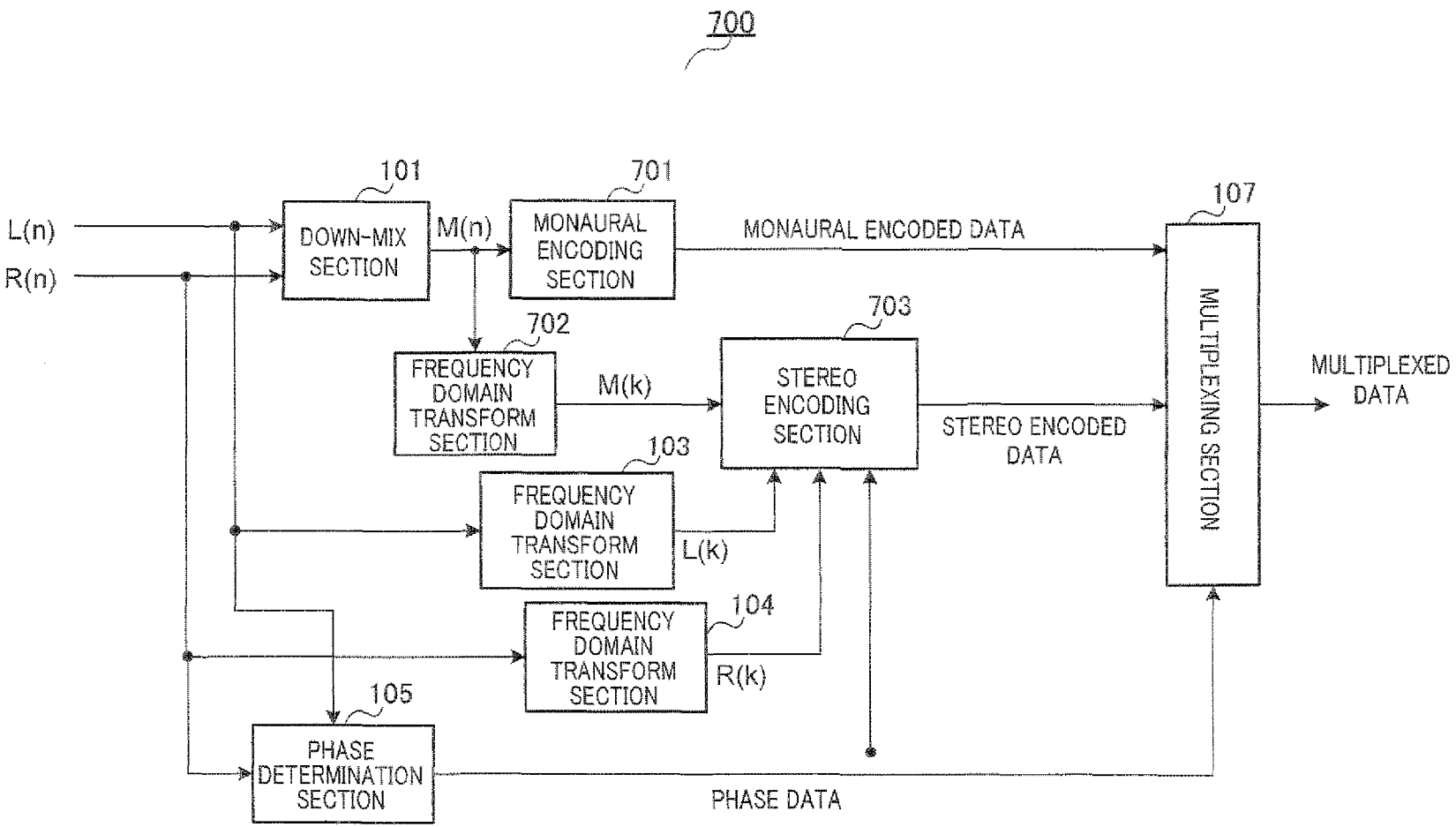
FIG. 7 is a block diagram illustrating the configuration of an acoustic signal transmitting apparatus according to Embodiment 2 of the present invention.

FIG. 7 is a block diagram illustrating the configuration of acoustic signal transmitting apparatus 700 according to Embodiment 2 of the present invention.

The configuration of the acoustic signal transmitting apparatus 700 illustrated in FIG. 7 is the same as that of the acoustic signal transmitting apparatus 100 of Embodiment 1 illustrated in FIG. 3, except that frequency domain transform section 702 is additionally included, and acoustic signal transmitting apparatus 100 concerning Embodiment 1 shown in FIG. 3, monaural encoding section 701 is provided instead of monaural encoding section 102, and stereo encoding section 703 is provided instead of stereo encoding section 106. In FIG. 7, the same reference symbols as in FIG. 3 are used to denote the corresponding portions and the description thereof will not be repeated here.

Acoustic signal transmitting apparatus 700 mainly includes down-mix section 101, frequency domain transform section 103, frequency domain transform section 104, phase determination section 105, multiplexing section 107, monaural encoding section 701, frequency domain transform section 702, and stereo encoding section 703. Hereinafter, each configuration will be described in detail.

Down mix section 101 performs down mix processing of a stereo signal that includes an L-channel signal (L(n)) and an R-channel signal (R(n)), and generates a monaural signal (M(n)). Then down-mix section 101 outputs the generated monaural signal to monaural encoding section 701 and frequency domain transform section 702.

Monaural encoding section 701 encodes the monaural signal input from down-mix section 101, and outputs the monaural encoded data as a result of the encoding to multiplexing section 107.

Frequency domain transform section 702 calculates monaural MDCT coefficients (M(k)) by carrying out frequency conversion of the monaural signal input from down-mix section 101 to a frequency domain signal from a time domain signal. Frequency domain transform section 702 outputs the calculated monaural MDCT coefficients to stereo encoding section 703.

Frequency domain transform section 103 calculates L-channel MDCT coefficients (L(k)) by performing frequency domain transform of the input L-channel signal. Then, frequency domain transform section 103 outputs the calculated L-channel MDCT coefficients to stereo encoding section 703.

Frequency domain transform section 104 calculates R-channel MDCT coefficients (R(k)) by performing frequency domain transform of the input R-channel signal. Then, frequency domain transform section 104 outputs the calculated R-channel MDCT coefficients to stereo encoding section 703.

Phase determination section 105 calculates a phase difference which is a time lag of an L-channel signal and an R-channel signal by performing a correlation analysis for the correlation between an input R-channel signal and an input L-channel signal. Then, phase determination section 105 is output to stereo encoding section 703 and multiplexing section 107 by using the calculated phase difference a calculated s phase data.

Stereo encoding section 703 has a basic function as acoustic signal encoding apparatus. Stereo encoding section 703 uses the monaural MDCT coefficients input from frequency domain transform section 702. The L-channel MDCT coefficients input from frequency domain transform section 103 and the R-channel MDCT coefficients input from frequency domain transform section 104 are encoded to generate balance parameter encoded data. The internal configuration of stereo encoding section 703 is the same as that of the configuration of stereo encoding section 106 of FIG. 5 where decoded monaural MDCT coefficients M'(k), which is one of inputs, is substituted with monaural MDCT coefficients M(k). Furthermore, stereo encoding section 703 outputs stereo encoded data containing the generated balance parameter encoded data and the like to multiplexing section 107.

The configuration of the acoustic signal receiving apparatus of the present embodiment is the same as one illustrated in FIG. 4. Since the concrete method for generating L-channel changing monaural MDCT coefficients and R-channel changing monaural MDCT coefficients in monaural MDCT coefficient correction section is the same as that of Embodiment 1 as described above, the description is omitted.

Thus, according to the present embodiment, an L-channel signal and an R-channel signal are predicted using the monaural signal corrected according to the phase difference between the L-channel signal and the R-channel signal. Therefore, from a monaural signal, it is possible to avoid a decrease in performance of predicting an L-channel signal and an R-channel signal. Thus, a high-quality sound encoding can be realized.

Embodiment 3

Figure 8:
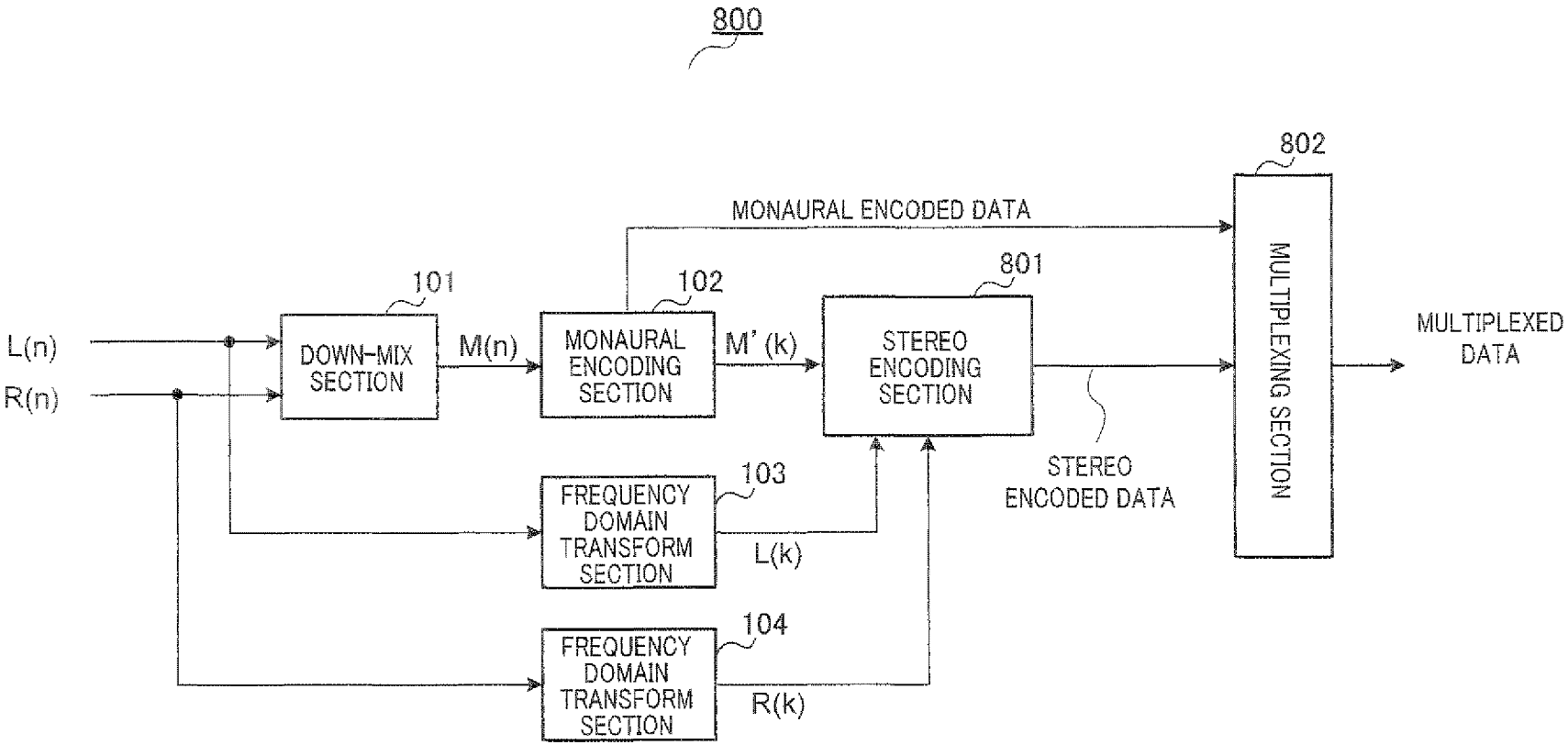
FIG. 8 is a block diagram illustrating the configuration of an acoustic signal transmitting apparatus according to Embodiment 3 of the present invention.

FIG. 8 is a block diagram illustrating the configuration of acoustic signal transmitting apparatus 800 according to Embodiment 3 of the present invention.

The configuration of the acoustic signal transmitting apparatus 800 illustrated in FIG. 8 is the same as that of the acoustic signal transmitting apparatus 100 of Embodiment 1 illustrated in FIG. 3, except that phase determination section 105 is removed, stereo encoding section 801 is installed instead of stereo encoding section 106, and multiplexing section 802 is installed instead of multiplexing section 107. In FIG. 8, the same reference symbols as in FIG. 3 are used to denote the corresponding portions and the description thereof will not be repeated here.

Acoustic signal transmitting apparatus 800 mainly includes down-mix section 101, monaural encoding section 102, frequency domain transform section 103, frequency domain transform section 104, stereo encoding section 801, and multiplexing section 802. Hereinafter, each configuration will be described in detail.

Monaural encoding section 102 encodes the monaural signal input from down-mix section 101, and outputs the monaural encoded data as a result of the encoding to multiplexing section 802. Monaural encoding section 102 outputs decoded monaural MDCT coefficients (M'(k)) obtained by encoding processing of the monaural signal input from down-mix section 101 to stereo encoding section 801.

Frequency domain transform section 103 calculates L-channel MDCT coefficients (L(k)) by performing frequency domain transform of the input L-channel signal. Then, frequency domain transform section 103 outputs the calculated L-channel MDCT coefficients to stereo encoding section 801.

Frequency domain transform section 104 calculates R-channel MDCT coefficients (R(k)) by performing frequency domain transform of the input R-channel signal. Then, frequency domain transform section 104 outputs the calculated R-channel MDCT coefficients to stereo encoding section 801.

Stereo encoding section 801 uses the decoded monaural MDCT coefficients input from monaural encoding section 102. The L-channel MDCT coefficients input from frequency domain transform section 103 and the R-channel MDCT coefficients input from frequency domain transform section 104 are encoded to acquire a balance parameter. In this case, stereo encoding section 801 compares the energy of the L-channel MDCT coefficients and the energy of the R-channel MDCT coefficients. To decoded monaural MDCT coefficients to be used for the channel of lower energy, a process of changing decoded monaural MDCT coefficients is performed, and the decoded monaural MDCT coefficients after the change process are used. Stereo encoding section 801 outputs stereo encoded data, which contains a balance parameter encoded data acquired by encoding processing, to multiplexing section 802. Here, the details of the configuration of stereo encoding section 801 will be described later.

Multiplexing section 802 generates multiplexed data by multiplexing the monaural encoded data input from monaural encoding section 102 and the stereo encoded data input from stereo encoding section 801. Then, multiplexing section 802 outputs the multiplexed data to a communication path (not illustrated).

Now, the description of the configuration of acoustic signal transmitting apparatus 800 is finished.

Figure 9:
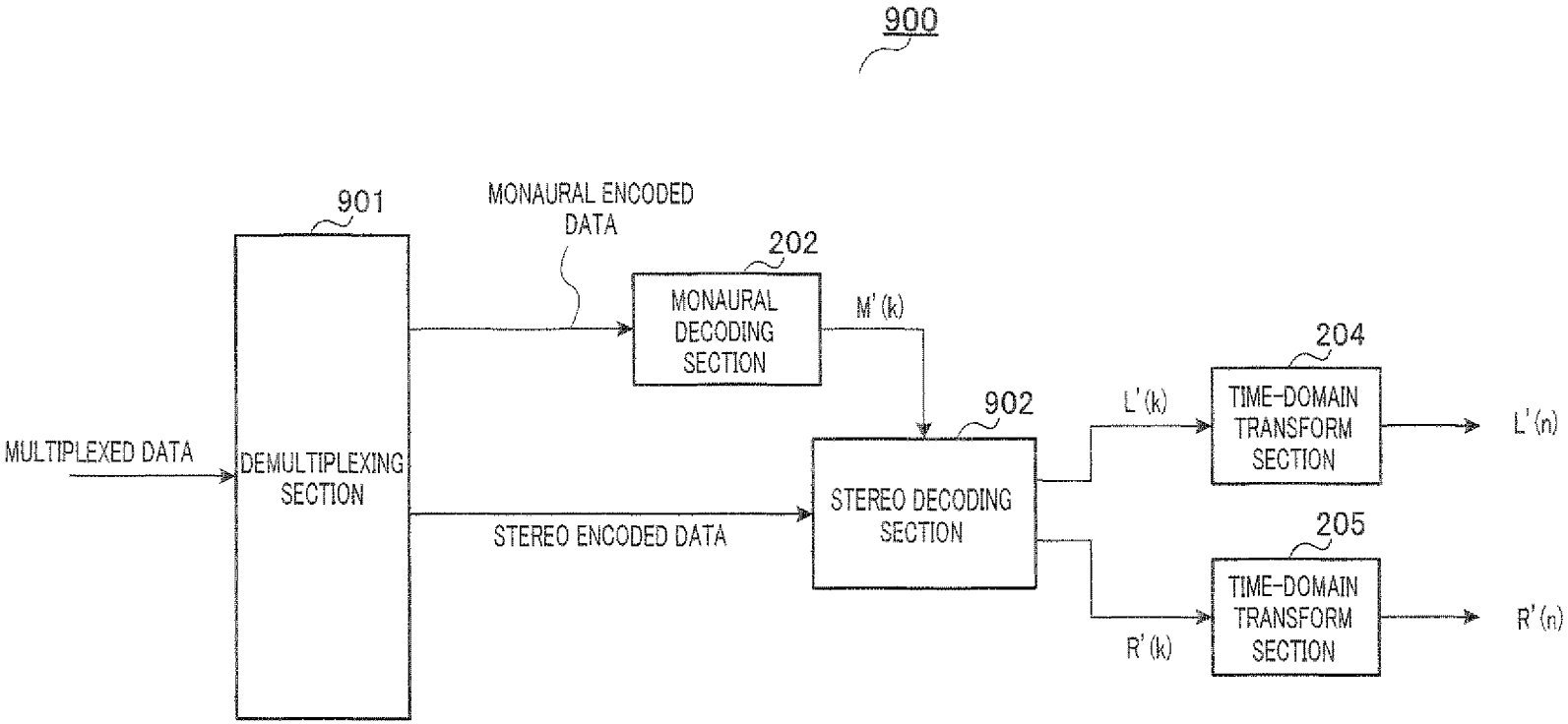
FIG. 9 is a block diagram illustrating the configuration of an acoustic signal receiving apparatus according to Embodiment 3 of the present invention.

Next, the configuration of acoustic signal receiving apparatus 900 is described with reference to FIG. 9. FIG. 9 is a block diagram illustrating the configuration of acoustic signal receiving apparatus 900.

The configuration of the acoustic signal receiving apparatus 900 illustrated in FIG. 9 is the same as that of the acoustic signal receiving apparatus 200 of Embodiment 1 illustrated in FIG. 4, except that demultiplexing section 901 is used instead of demultiplexing section 201 and stereo decoding section 902 is used instead of stereo decoding section 203. In FIG. 9, the same reference symbols as in FIG. 4 are used to denote the corresponding portions and the description thereof will not be repeated here.

Acoustic signal receiving apparatus 900 mainly includes monaural decoding section 202, time-domain transform section 204, time-domain transform section 205, demultiplexing section 901, and stereo decoding section 902. Hereinafter, each configuration will be described in detail.

Demultiplexing section 901 receives multiplexed data sent out from acoustic signal transmitting apparatus 800, and divides the received multiplexed data into monaural encoded data and stereo encoded data. Then, demultiplexing section 901 outputs monaural encoded data to monaural decoding section 202, and outputs stereo encoded data to stereo decoding section 902.

Monaural decoding section 202 decodes a monaural signal using the monaural encoded data input from demultiplexing section 901, and outputs the decoded monaural MDCT coefficients (M'(k)), which are MDCT coefficients of a decoding monaural signal, to stereo decoding section 902.

Stereo decoding section 902 calculates L-channel decoded MDCT coefficients (L'(k)) and R-channel decoded MDCT coefficients (R'(k)) by using the decoded monaural MDCT coefficients input from monaural decoding section 202 and the stereo encoded data input from demultiplexing section 901. Then stereo decoding section 902 outputs the calculated R-channel decoded MDCT coefficients to time-domain transform section 205, while outputting the calculated L-channel decoded MDCT coefficients to time-domain transform section 204. Here, the details of the configuration of stereo decoding section 902 will be described later.

Now, the description of the configuration of acoustic signal receiving apparatus 900 is finished.

Figure 10:
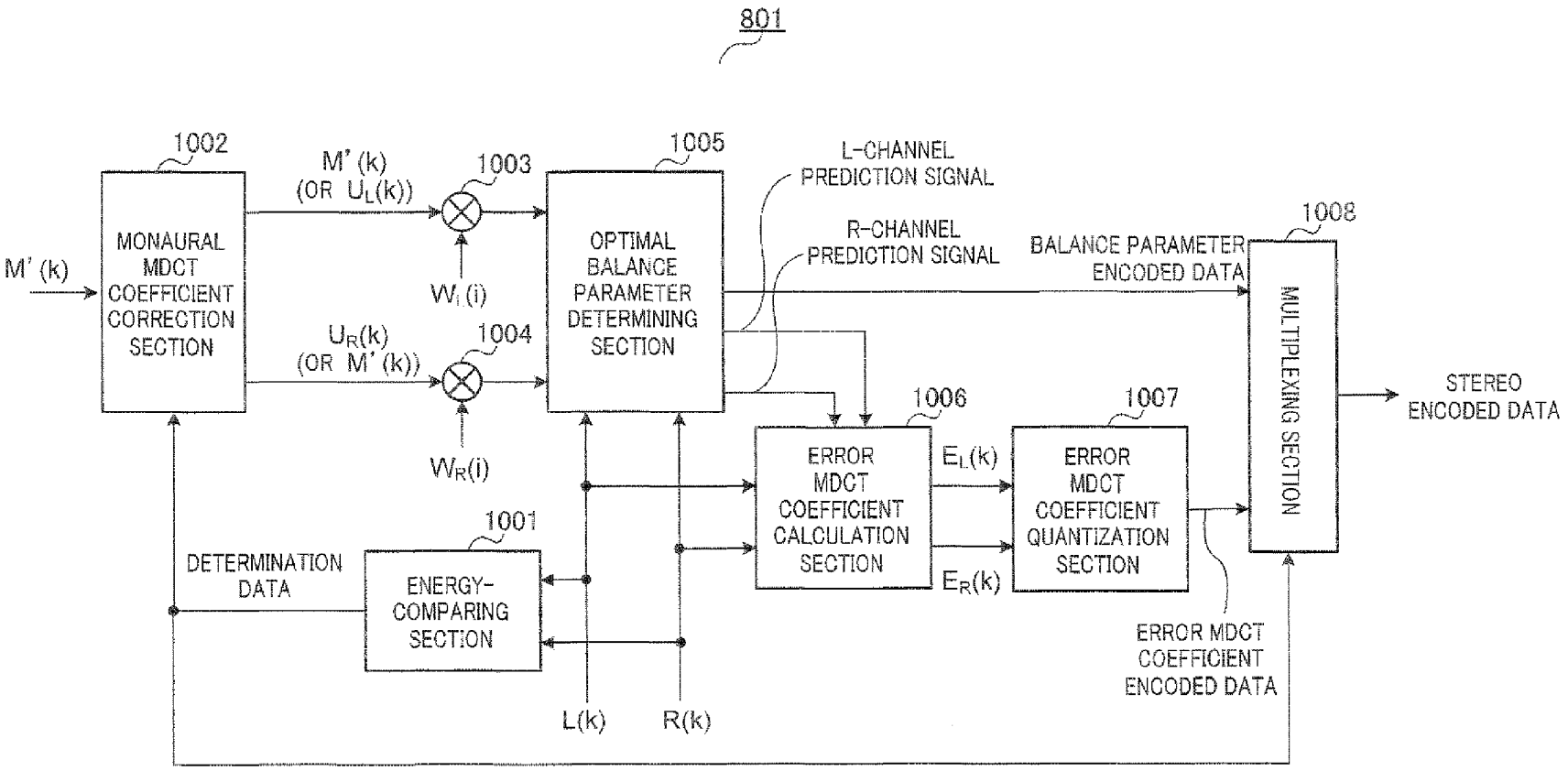
FIG. 10 is a block diagram illustrating the configuration of a stereo encoding section according to Embodiment 3 of the present invention.

Next, the details of the configuration of stereo encoding section 801 will be described with reference to FIG. 10. FIG. 10 is a block diagram illustrating the configuration of stereo encoding section 801. Stereo encoding section 801 has a basic function as acoustic signal encoding apparatus.

Stereo encoding section 801 mainly includes energy-comparing section 1001, monaural MDCT coefficient correction section 1002, multiplier 1003, multiplier 1004, optimal balance parameter determining section 1005, error MDCT coefficient calculation section 1006, error MDCT coefficient quantization section 1007, and multiplexing section 1008. Hereinafter, each configuration will be described in detail.

Energy-comparing section 1001 compares the amount of energy of the L-channel MDCT coefficients input from frequency domain transform section 103 with the amount of energy of the R-channel MDCT coefficients input from frequency domain transform section 104. Then, energy-comparing section 1001 outputs the determination data representing the channel of lower energy to monaural MDCT coefficient correction section 1002 and multiplexing section 1008.

Monaural MDCT coefficient correction section 1002 compensates the phase difference of an L-channel signal and an R-channel signal with respect to the decoded monaural MDCT coefficients input from monaural encoding section 102 based on the determination data input from energy-comparing section 1001 to generate L-channel changing monaural MDCT coefficients ($U_L(k)$) or R-channel changing monaural MDCT coefficients ($U_R(k)$). Then, when L-channel changing monaural MDCT coefficients is generated, monaural MDCT coefficient correction section 1002 outputs the generated L-channel changing monaural MDCT coefficients to multiplier 1003, while outputs the decoded monaural MDCT coefficients to multiplier 1004. On the other hand, monaural MDCT coefficient correction section 1002 outputs decoded monaural MDCT coefficients to multiplier 1003 while outputting the generated R-channel changing monaural MDCT coefficients to multiplier 1004, when the R-channel changing monaural MDCT coefficients are generated. Here, the details of the configuration of monaural MDCT coefficient correction section 1002 will be described later.

Multiplier 1003 multiplies the L-channel changing monaural MDCT coefficients input from monaural MDCT coefficient correction section 1002 or the decoded monaural MDCT coefficients by the i-th candidate's balance parameter ($W_L(i)$). A multiplication result ($U_L(k)\cdot W_L(i)$ or $M'(k)\cdot W_L(i)$) (i.e. a candidate of an L-channel prediction signal) is output to optimal balance parameter determining section 1005.

Multiplier 1004 multiplies the R-channel changing monaural MDCT coefficients input from monaural MDCT coefficient correction section 1002, or decoded monaural MDCT coefficients by the i-th candidate's balance parameter ($W_R(i)$). A multiplication result ($U_R(k)\cdot W_R(i)$, or $M'(k)'W_R(i)$) (i.e. a candidate of an R-channel prediction signal) is output to optimal balance parameter determining section 1005.

Optimal balance parameter determining section 1005 calculates a difference between the candidate of an L-channel prediction signal and the L-channel MDCT coefficients input from frequency domain transform section 103. In addition, optimal balance parameter determining section 1005 calculates a difference between the candidate of an R-channel prediction signal and the R-channel MDCT coefficients input from frequency domain transform section 104. Furthermore, optimal balance parameter determining section 1005 determines a balance parameter ($W_L(i_{opt})$, $W_R(i_{opt})$) when the sum of both differences becomes the smallest. The candidates of the prediction signals of L-channel and R-channel serve as prediction signals of L-channel and R-channel, respectively. Then, optimal balance parameter determining section 1005 encodes the index which specifies the determined balance parameter, and generates balance parameter encoded data. Then optimal balance parameter determining section 1005 outputs the generated balance parameter encoded data to multiplexing section 1008. Furthermore, optimal balance parameter determining section 1005 outputs an L-channel prediction signal and an R-channel prediction signal to error MDCT coefficient calculation section 1006.

Error MDCT coefficient calculation section 1006 subtracts the L-channel prediction signal input from optimal balance parameter determining section 1005 from the L-channel MDCT coefficients input from frequency domain transform section 103 to obtain L-channel error MDCT coefficients ($E_L(k)$). Error MDCT coefficient calculation section 1006 subtracts the R-channel prediction signal input from optimal balance parameter determining section 1005 from the R-channel MDCT coefficients input from frequency domain transform section 104 to obtain an R-channel error MDCT coefficients ($E_R(k)$). Then, error MDCT coefficient calculation section 1006 outputs the calculated L-channel error MDCT coefficients and R-channel error MDCT coefficients to error MDCT coefficient quantization section 1007.

Error MDCT coefficient quantization section 1007 quantizes the L-channel error MDCT coefficients and R-channel error MDCT coefficients which were input from error MDCT coefficient calculation section 1006, and calculates for error MDCT coefficient encoded data. Then, error MDCT coefficient quantization section 1007 outputs the obtained error MDCT coefficient encoded data to multiplexing section 1008.

Multiplexing section 1008 multiplexes the balance parameter encoded data input from optimal balance parameter determining section 1005, the error MDCT coefficient encoded data input from error MDCT coefficient quantization section 1007, and the determination data input from energy-comparing section 1001. Then, multiplexing section 1008 outputs the multiplexed data as stereo encoded data to multiplexing section 802. Multiplexing section 1008 is not essential to this embodiment. When multiplexing section 1008 is deleted, optimal balance parameter determining section 1005 may carry out the direct output of the balance parameter encoded data to multiplexing section 802. Error MDCT coefficient quantization section 1007 may directly output the direct output of the error MDCT coefficient encoded data to multiplexing section 802. Energy-comparing section 1001 may carry out the direct output of the determination data to multiplexing section 802.

Now, the description of the configuration of stereo encoding section 801 is finished.

Figure 11:
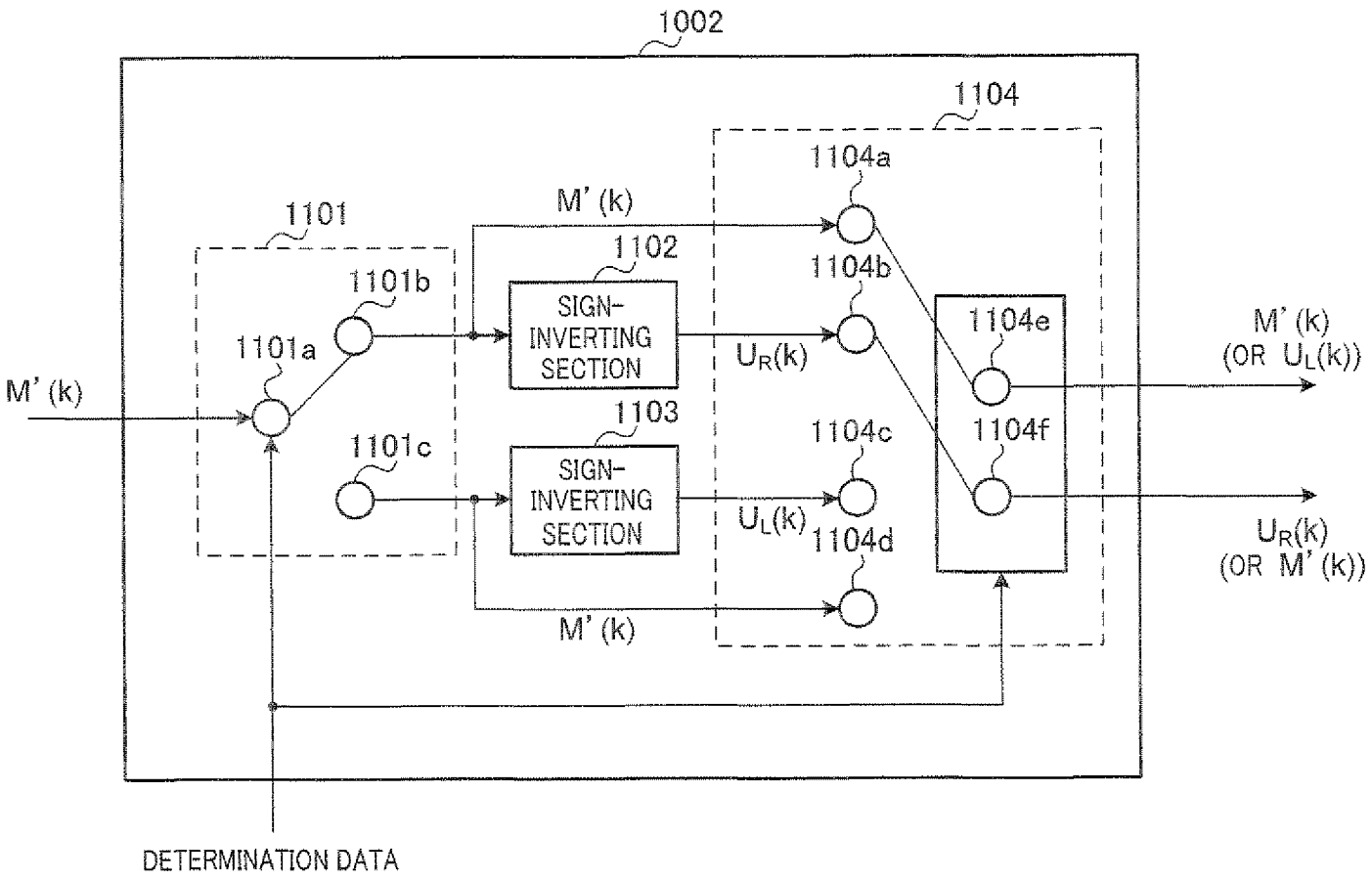
FIG. 11 is a block diagram illustrating the configuration of a monaural MDCT coefficient correction section according to Embodiment 3 of the present invention.

Next, the configuration of monaural MDCT coefficient correction section 1002 is described with reference to FIG. 11. FIG. 11 a block diagram illustrating the configuration of monaural MDCT coefficient correction section 1002.

Monaural MDCT coefficient correction section 1002 mainly includes switching section 1101, sign-inverting section 1102, sign-inverting section 1103, and switching section 1104. Hereinafter, each configuration will be described in detail.

Switching section 1101 connects switching terminal 1101*a* and switching terminal 1101*b* together when the determination data that the energy of R-channel MDCT coefficients is smaller than the energy of L-channel MDCT coefficients is input from energy-comparing section 1001. Therefore, switching section 1101 outputs decoded monaural MDCT coefficients ($M'(k)$) to switching section 1104 and sign-inverting section 1102. Switching section 1101 connects switching terminal 1101*a* and switching terminal 1101*c* together when the determination data that the energy of L-channel MDCT coefficients is smaller than the energy of R-channel MDCT coefficients is input from energy-comparing section 1001. Therefore, switching section 1101 outputs decoded monaural MDCT coefficients to sign-inverting section 1103 and switching section 1104.

Sign-inverting section 1102 inverts a sign of the decoded monaural MDCT coefficients input from switching section 1101, and outputs them to switching section 1104. That is, when the energy of R-channel MDCT coefficients is smaller than the energy of an L-channel MDCT coefficients, sign-inverting section 1102 inverts a sign of decoded monaural MDCT coefficients, and outputs them to switching section 1104 as R-channel changing monaural MDCT coefficients ($U_R(k)$).

Sign-inverting section 1103 inverts a sign of decoded monaural MDCT coefficients input from switching section 1101, and outputs them to switching section 1104. That is, when the energy of L-channel MDCT coefficients is smaller than the energy of R-channel MDCT coefficients, sign-inverting section 1103 inverts a sign of decoded monaural MDCT coefficients, and outputs them to switching section 1104 as L-channel changing monaural MDCT coefficients ($U_L(k)$).

When determination data that the energy of R-channel MDCT coefficients is smaller than the energy of L-channel MDCT coefficients is input from energy-comparing section 1001, switching section 1104 connects switching terminal 1104*a* and switching terminal 1104*e* together and also connects switching terminal 1104*b* and switching terminal 1104*f* together. Therefore, switching section 1104 outputs the decoded monaural MDCT coefficients input from switching section 1101 to multiplier 1003. Simultaneously switching section 1104 outputs the R-channel changing monaural MDCT coefficients input from sign-inverting section 1102 to multiplier 1004. When determination data that the energy of L-channel MDCT coefficients is smaller than the energy of R-channel MDCT coefficients is input from energy-comparing section 1001, switching section 1104 connects switching terminal 1104*c* and switching terminal 1104*e* together and also connects switching terminal 1104*d* and switching terminal 1104*f* together. Therefore, switching section 1104 outputs the L-channel changing monaural MDCT coefficients input from sign-inverting section 1103 to multiplier 1003. Simultaneously, switching section 1104 outputs the decoded monaural MDCT coefficients input from switching section 1101 to multiplier 1004.

Now, the description of the configuration of monaural MDCT coefficient correction section 1002 is finished.

In optimal balance parameter determining section 1005, it may be determined whether the sign of decoded monaural MDCT coefficients is reversed. In this case, error MDCT coefficients obtained when the sign of the error MDCT coefficients is reversed and error MDCT coefficients obtained when the sign of the error MDCT coefficients is not reversed are calculated. Then, the energies of the error MDCT coefficients are compared. Then, the optimal balance parameter determining section 1005 may be designed so that it selects the error MDCT coefficients of lower energy and output information that represents whether the sign of the decoded monaural MDCT coefficients is output. In this case, stereo encoding section 801 generates stereo encoded data also including this information, and acoustic signal transmitting apparatus 800 transmits the multiplexed data containing the stereo encoded data. Acoustic signal receiving apparatus 900 in this case receives the multiplexed data, and separates this information by demultiplexing section 901. Then, the information is input into stereo decoding section 902.

Figure 12:
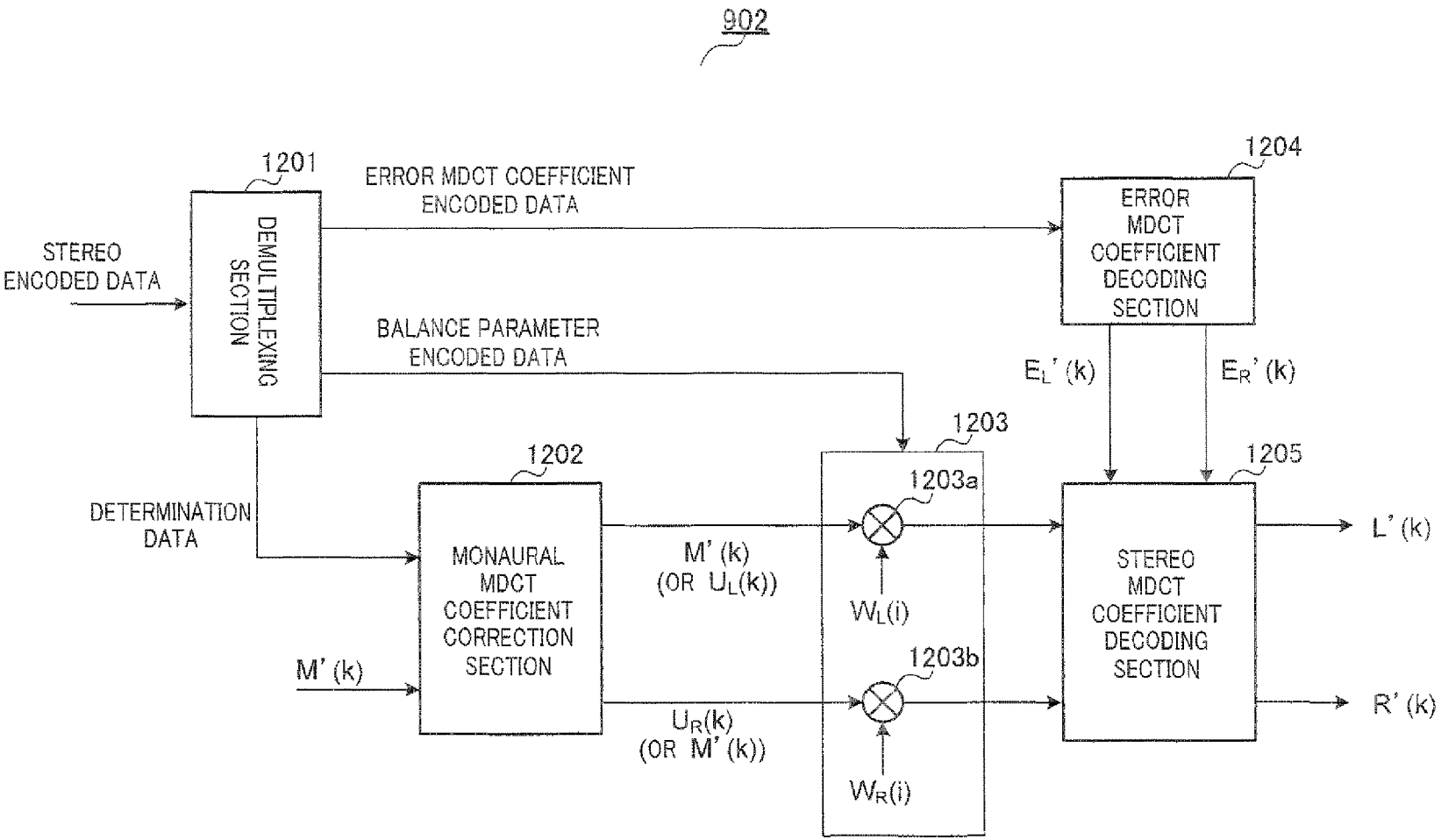
FIG. 12 is a block diagram illustrating the configuration of a stereo decoding section according to Embodiment 3 of the present invention.

Next, the configuration of stereo decoding section 902 will be described with reference to FIG. 12. FIG. 12 is a block diagram that illustrates the configuration of stereo decoding section 902. Stereo decoding section 902 has a basic function as acoustic signal decoding apparatus.

Stereo decoding section 902 mainly includes demultiplexing section 1201, monaural MDCT coefficient correction section 1202, multiplying section 1203, error MDCT coefficient decoding section 1204, and stereo MDCT coefficient decoding section 1205. Hereinafter, each configuration will be described in detail.

Demultiplexing section 1201 divides stereo encoded data input from demultiplexing section 901 into balance parameter encoded data, error MDCT coefficient encoded data, and determination data. Then, demultiplexing section 1201 outputs balance parameter encoded data to multiplying section 1203, outputs error MDCT coefficient encoded data to error MDCT coefficient decoding section 1204, and outputs determination data to monaural MDCT coefficient correction section 1202. Demultiplexing section 1201 is not essential to this embodiment. Demultiplexing section 901 may divide the data into balance parameter encoded data, error MDCT coefficient encoded data, and determination data, demultiplexing section 901 may directly output balance parameter encoded data to multiplying section 1203, directly outputs error MDCT coefficient encoded data to error MDCT coefficient decoding section 1204, and directly outputs determination data to monaural MDCT coefficient correction section 1202.

Monaural MDCT coefficient correction section 1202 performs change processing on the decoded monaural MDCT coefficients in a manner similar to that of compensating the phase difference of the L-channel signal and R-channel signal, which was performed by the encoding apparatus side. In other words, monaural MDCT coefficient correction section 1202 makes any modification to the decoded monaural MDCT coefficients (M'(k)) input from demultiplexing section 901 based on the determination data input from demultiplexing section 1201 so that a phase difference between an L-channel signal and an R-channel signal is compensated to obtain L-channel changing monaural MDCT coefficients ($U_L$(k)) and R-channel changing monaural MDCT coefficients ($U_R$(k)). Then, when L-channel changing monaural MDCT coefficients are generated, monaural MDCT coefficient correction section 1202 outputs the generated L-channel changing monaural MDCT coefficients and the decoded monaural MDCT coefficients to multiplying section 1203. Then, when R-channel changing monaural MDCT coefficients are generated, monaural MDCT coefficient correction section 1202 outputs the generated R-channel changing monaural MDCT coefficients and the decoded monaural MDCT coefficients to multiplying section 1203.

In multiplying section 1203, when L-channel changing monaural MDCT coefficients and decoded monaural MDCT coefficients are input from monaural MDCT coefficient correction section 1202, multiplier 1203*a* multiplies the L-channel changing monaural MDCT coefficients input from monaural MDCT coefficient correction section 1202 by the optimal balance parameter ($W_L(i_{opt})$) specified by the balance parameter encoded data input from demultiplexing section 1201. As a result, a multiplication result ($W_L(i_{opt})$ and $U_L$(k)) (i.e. an L-channel prediction signal) is acquired. Simultaneously, multiplier 1203*b* multiplies the decoded monaural MDCT coefficients input from monaural MDCT coefficient correction section 1202 by the optimal balance parameter ($W_R(i_{opt})$) specified by balance parameter encoded data input from demultiplexing section 1201. As a result, multiplication result ($W_R(i_{opt})$ and M'(k)) (i.e. an R-channel prediction signal) is acquired. In multiplying section 1203, when R-channel changing monaural MDCT coefficients and decoded monaural MDCT coefficients are input from monaural MDCT coefficient correction section 1202, multiplier 1203*a* multiplies the decoded monaural MDCT coefficients input from monaural MDCT coefficient correction section 1202 by the optimal balance parameter ($W_L(i_{opt})$) specified by balance parameter encoded data input from demultiplexing section 1201. As a result, a multiplication result ($W_L(i_{opt})$ and M'(k)) (i.e. an L-channel prediction signal) is acquired. Simultaneously, multiplier 1203*b* multiplies the R-channel changing monaural MDCT coefficients input from monaural MDCT coefficient correction section 1202 by the optimal balance parameter ($W_R(i_{opt})$) specified by the balance parameter encoded data input from demultiplexing section 1201. As a result, multiplication result ($W_R(i_{opt})$ and $U_R$(k)) (i.e. an R-channel prediction signal) is acquired. Subsequently, multiplying section 1203 outputs each acquired prediction signal to stereo MDCT coefficient decoding section 1205.

Error MDCT coefficient decoding section 1204 decodes L-channel error MDCT coefficients using the error MDCT coefficient encoded data input from demultiplexing section 1201. Then, Error MDCT coefficient decoding section 1204 outputs a decoding result ($E_L$'(k)) to stereo MDCT coefficient decoding section 1205. Error MDCT coefficient decoding section 1204 decodes R-channel error MDCT coefficients using the error MDCT coefficient encoded data input from demultiplexing section 1201. Error MDCT coefficient decoding section 1204 outputs a decoding result (ER'(k)) to stereo MDCT coefficient decoding section 1205.

Stereo MDCT coefficient decoding section 1205 adds the decoding result of the L-channel error MDCT coefficients input from the error MDCT coefficient decoding section 1204 to the L-channel prediction signal input from multiplier 1203*a* of multiplying section 1203 to obtain L-channel decoded MDCT coefficients (L'(k)). The calculated L-channel decoded MDCT coefficients are output. Stereo MDCT coefficient decoding section 1205 adds the decoding result of the R-channel error MDCT coefficients input from the error MDCT coefficient decoding section 1204 to the R-channel prediction signal input from multiplier 1203*b* of multiplying section 1203 to obtain R-channel decoded MDCT coefficients (R'(k)). The calculated R-channel decoded MDCT coefficients are output.

Now, the description of the configuration of stereo decoding section 902 is finished.

According to the present embodiment, in addition to the effects of Embodiment 1 as described above, when an L-channel signal and an R-channel signal are predicted using the monaural MDCT coefficients after correction, the channel of lower energy, which is greatly influenced by a phase difference, is selected and the decoded monaural MDCT coefficients thereof are changed. Thus, it becomes possible to prevent an increase in size of operation and memory capacity while retaining an improvement of prediction performance of an L-channel signal and an R-channel.

In this embodiment, L-channel MDCT coefficients and R-channel MDCT coefficients may be divided into a plurality of subbands, the energy of L-channel and the energy of R-channel may be compared for every subband, and the channel of lower energy may be selected for every subband. Here, there are signals having characteristics of a large difference between the energy of L-channel and the energy of the R-channel for every subband. In the case of such a signal, a channel using sign-inverted monaural MDCT coefficients are selected for every subband. Thus, a prediction according to the energy of L-channel and the energy of R-channel for every signal can be performed, so that the prediction performance can be further improved.

Monaural MDCT coefficients are divided into a plurality of subbands in advance and a predetermined number of subbands where the energy of monaural, MDCT is larger than a predetermined value is then selected. For the selected subband, the energy of L-channel and the energy of R-channel are compared. The channel of lower energy may be also selected for each subband. In this case, the present embodiment is applied to a subband having a large energy, or one with a large influence of phase difference. Prediction performance can be improved and the selection information is limited to the predetermined number. Thus, the amount of multiplexed data can be prevented from increasing.

Embodiment 4

Figure 13:
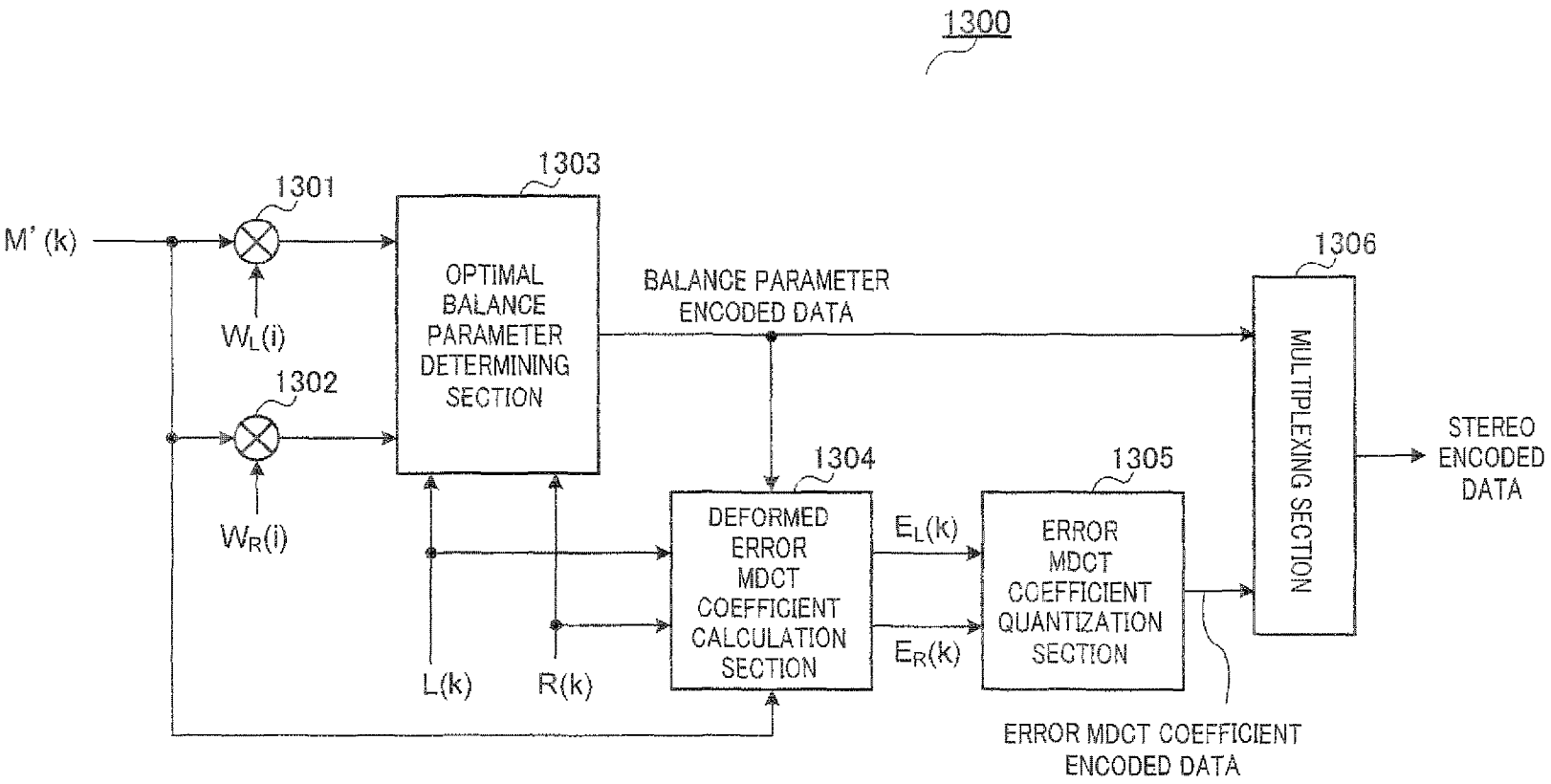
FIG. 13 is a block diagram illustrating the configuration of a stereo encoding section according to Embodiment 4 of the present invention.

FIG. 13 is a block diagram illustrating the configuration of stereo encoding section 1300 according to Embodiment 4 of the present invention. Stereo encoding section 1300 has a basic function as acoustic signal encoding apparatus. In this embodiment, since the configuration of acoustic signal transmitting apparatus is the same as one illustrated in FIG. 3, except that stereo encoding section 1300 is used. Thus, the description thereof will not be repeated here. In the following description, furthermore, structural components other than stereo encoding section 1300 are described using the same reference numerals as those illustrated in FIG. 3.

Stereo encoding section 1300 mainly includes multiplier 1301, multiplier 1302, optimal balance parameter determining section 1303, deformed error MDCT coefficients calculation section 1304, error MDCT coefficient quantization section 1305, and multiplexing section 1306. Hereinafter, each configuration will be described in detail.

Multiplier 1301 multiplies the decoded monaural MDCT coefficients (M'(k)) input from monaural encoding section 102 by the i-th candidate's balance parameter ($W_L(i)$). A multiplication result (M'(k) and $W_L(i)$) (i.e. the candidate of an L-channel prediction signal) is output to optimal balance parameter determining section 1303.

Multiplier 1302 multiplies the decoded monaural MDCT coefficients (M'(k)) input from monaural encoding section 102 by the i-th candidate's balance parameter ($W_R(i)$). A multiplication result (M'(k) and $W_R(i)$) (i.e. the candidate of an R-channel prediction signal) is output to optimal balance parameter determining section 1303.

Optimal balance parameter determining section 1303 searches for the error of the L-channel MDCT coefficients (L(k)) input from frequency domain transform section 103 and a candidate of an L-channel prediction signal. Optimal balance parameter determining section 1303 searches for the error of the R-channel MDCT coefficients (R(k)) input from frequency domain transform section 104 and the candidate of an R-channel prediction signal. Furthermore, optimal balance parameter determining section 1303 determines a balance parameter ($W_L(i_{opt})$, $W_R(i_{opt})$) when the sum of both differences becomes the smallest. The candidates of the prediction signals of L-channel and R-channel serve as prediction signals of L-channel and R-channel, respectively. Then, optimal balance parameter determining section 1303 encodes an index that specifies the determined balance parameter, and outputs it to deformed error MDCT coefficient calculation section 1304 and multiplexing section 1306 as balance parameter encoded data.

Deformed error MDCT coefficient calculation section 1304 calculates L-channel error MDCT coefficients ($E_L(k)$) and R-channel error MDCT coefficients ($E_R(k)$) using balance parameter encoded data input from optimal balance parameter determining section 1303, L-channel MDCT coefficients input from frequency domain transform section 103, R-channel MDCT coefficients input from frequency domain transform section 104, and decoded monaural MDCT coefficients input from monaural encoding section 102. Then, deformed error MDCT coefficient calculation section 1304 outputs the calculated L-channel error MDCT coefficients and the calculated R-channel error MDCT coefficients to error MDCT coefficient quantization section 1305. The details of the configuration of deformed error MDCT coefficient calculation section 1304 are described later.

Error MDCT coefficient quantization section 1305 quantizes the L-channel error MDCT coefficients and R-channel error MDCT coefficients, which are input from deformed error MDCT coefficient calculation section 1304, and calculates error MDCT coefficient encoded data. Then, error MDCT coefficient quantization section 1305 outputs the obtained error MDCT coefficient encoded data to multiplexing section 1306.

Multiplexing section 1306 multiplexes the balance parameter encoded data input from optimal balance parameter determining section 1303, and the error MDCT coefficient encoded data input from error MDCT coefficient quantization section 1305, and outputs them to multiplexing section 107 as stereo encoded data. Multiplexing section 1306 is not essential to this embodiment. Optimal balance parameter determining section 1303 may directly output the balance parameter encoded data to multiplexing section 107, while error MDCT coefficient quantization section 1305 may carry out the direct output of the error MDCT coefficient encoded data to multiplexing section 107.

Now, the description of the configuration of stereo encoding section 1300 is finished.

Figure 14:
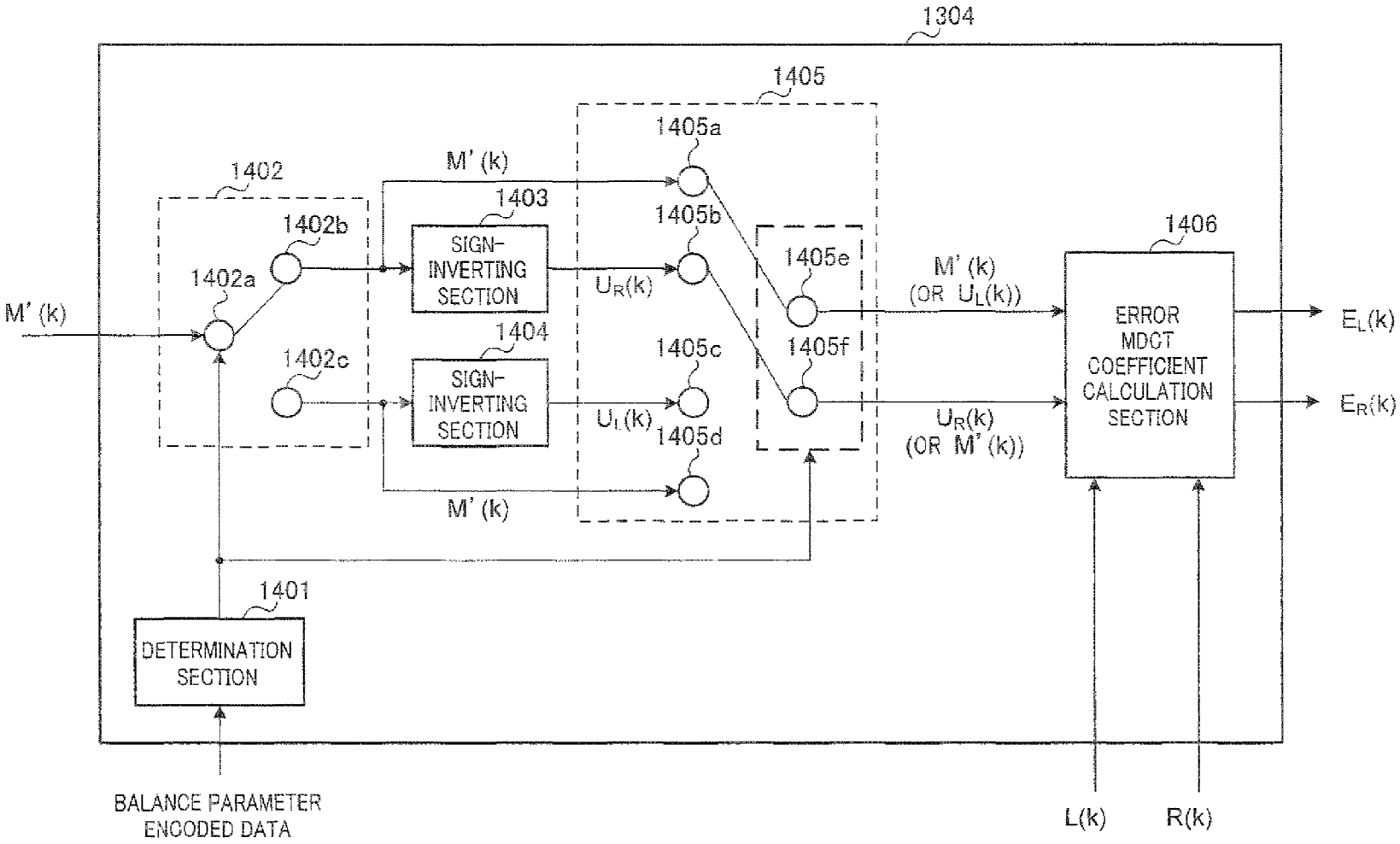
FIG. 14 is a block diagram illustrating the configuration of a deformed error MDCT coefficient calculation section according to Embodiment 4 of the present invention.

Next, the configuration of deformed error MDCT coefficient calculation section 1304 is described with reference to FIG. 14. FIG. 14 is a block diagram illustrating the configuration of deformed error MDCT coefficient calculation section 1304.

Deformed error MDCT coefficient calculation section 1304 mainly includes determination section 1401, switching section 1402, sign-inverting section 1403, sign-inverting section 1404, switching section 1405, and error MDCT coefficient calculation section 1406. Hereinafter, each configuration will be described in detail.

Determination section 1401 decodes a balance parameter using balance parameter encoded data input from optimal balance parameter determining section 1303. Then, determination section 1401 compares the balance parameter of L-channel with the balance parameter of R-channel, and outputs determination information representing the one having the smaller balance parameter between L-channel and R-channel to switching section 1402 and switching section 1405.

Switching section 1402 changes a signal line based on the determination information input from determination section 1401. Specifically, switching section 1402 connects switching terminal 1402*a* and switching terminal 1402*b* together when receiving an input of the determination information that the balance parameter of R-channel is smaller than the balance parameter of L-channel. Thus, switching section 1402 outputs the decoded monaural MDCT coefficients (M'(k)) input from monaural encoding section 102 to sign-inverting section 1403 and switching section 1405. Switching section 1402 connects switching terminal 1402*a* and switching terminal 1402*e*, when the determination information that the balance parameter of L-channel is smaller than the balance parameter of R-channel is input. Therefore, switching section 1402 outputs the decoded monaural MDCT coefficients input from monaural encoding section 102 to sign-inverting section 1404 and switching section 1405.

Sign-inverting section 1403 inverts a sign of decoded monaural MDCT coefficients input from switching section 1402 and outputs them to switching section 1405. Namely, when the balance parameter of R-channel is smaller than the balance parameter of L-channel, sign-inverting section 1403 inverts the sign of decoded monaural MDCT coefficients, and outputs them to switching section 1405 as R-channel changing monaural MDCT coefficients ($U_R(k)$).

Sign-inverting section 1404 inverts a sign of decoded monaural MDCT coefficients input from switching section 1402, and outputs them to switching section 1405. Namely, when the balance parameter of L-channel is smaller than the balance parameter of R-channel, sign-inverting section 1404 reverses the sign of decoded monaural MDCT coefficients, and outputs them to switching section 1405 as L-channel changing monaural MDCT coefficients ($U_L(k)$).

Switching section 1405 connects switching terminal 1405*a* and switching terminal 1405*e* together when receiving an input of the determination information that the balance parameter of R-channel is smaller than the balance parameter of L-channel. Simultaneously, switching terminal 1405*b* and switching terminal 1405*f* are connected. Therefore, switching section 1405 outputs the R-channel changing monaural MDCT coefficients input from the decoded monaural MDCT coefficients input from switching section 1402 and sign-inverting section 1403 to error MDCT coefficient calculation section 1406. Switching section 1405 connects switching terminal 1405*c* and switching terminal 1405*e* when receiving an input of the determination information that the balance parameter of L-channel is smaller than the balance parameter of R-channel, while connecting switching terminal 1405*d* and switching terminal 1045*f* together. Thus, switching section 1405 outputs the decoded monaural MDCT coefficients input from switching section 1402 and the L-channel changing monaural MDCT coefficients input from the sign-inverting section 1404 to error MDCT coefficient calculation section 1406.

Error MDCT coefficient calculation section 1406 performs the following processing, when decoded monaural MDCT coefficients and R-channel changing monaural MDCT coefficients are input from switching section 1405. That is, error MDCT coefficient calculation section 1406 subtracts the decoded monaural MDCT coefficients input from switching section 1405 from the L-channel MDCT coefficients (L(k)) input from frequency domain transform section 103, and calculates for L-channel error MDCT coefficients ($E_L(k)$). Error MDCT coefficient calculation section 1406 subtracts the R-channel changing monaural MDCT coefficients input from switching section 1405 from the R-channel MDCT coefficients (R(k)) input from frequency domain transform section 104, and calculates R-channel error MDCT coefficients ($E_R(k)$). Then, error MDCT coefficient calculation section 1406 outputs the obtained L-channel error MDCT coefficients and the obtained R-channel error MDCT coefficients to error MDCT coefficient quantization section 1305.

On the other hand, error MDCT coefficient calculation section 1406 performs the following processing, when decoded monaural MDCT coefficients and L-channel changing monaural MDCT coefficients are input from switching section 1405. That is error MDCT coefficient calculation section 1406 subtracts the decoded monaural MDCT coefficients input from switching section 1405 from the R-channel MDCT coefficients input from frequency domain transform section 104, and calculates for R-channel error MDCT coefficients ($E_R(k)$). Error MDCT coefficient calculation section 1406 subtracts the L-channel changing monaural MDCT coefficients input from switching section 1405 from the L-channel MDCT coefficients input from frequency domain transform section 103, and calculates for L-channel error MDCT coefficients ($E_L(k)$). Then, error MDCT coefficient calculation section 1406 outputs the obtained L-channel error MDCT coefficients and the obtained R-channel error MDCT coefficients to error MDCT coefficient quantization section 1305.

Now, the description of the configuration of deformed error MDCT coefficient calculation section 1304 is ended.

In deformed error MDCT coefficient calculation section 1304, it may be determined whether the sign of decoded monaural MDCT coefficients is inverted. In this case, error MDCT coefficients obtained when the sign of the error MDCT coefficients is reversed and error MDCT coefficients obtained when the sign of the error MDCT coefficients is not reversed are calculated. Then, the energies of the error MDCT coefficients are compared. Then, deformed error MDCT coefficient calculation section 1304 may be designed so that it selects error MDCT coefficients of lower energy and output information that represents whether the sign of the decoded monaural MDCT coefficients is output. In this case, stereo encoding section 1300 generates stereo encoded data also including this information, and acoustic signal transmitting apparatus transmits the multiplexed data containing the stereo encoded data. The acoustic signal receiving apparatus in this case receives these multiplexed data, and separates this information in the demultiplexing section. Then, this information is input into the stereo decoding section.

Figure 15:
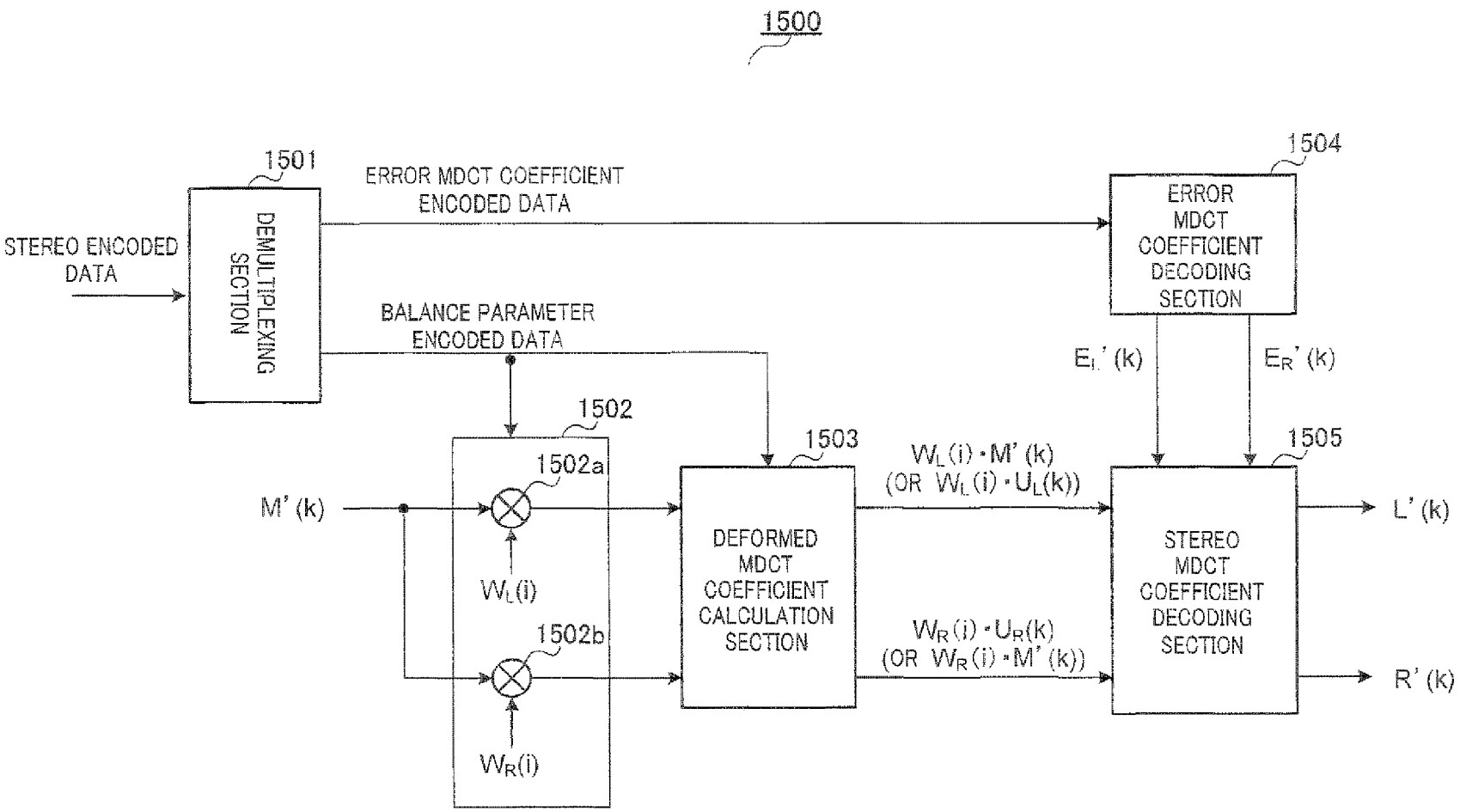
FIG. 15 is a block diagram illustrating the configuration of a stereo decoding section according to Embodiment 4 of the present invention.

Next, the configuration of stereo decoding section 1500 of the present embodiment is described with reference to FIG. 15. FIG. 15 is a block diagram that illustrates the configuration of stereo decoding section 1500. Stereo decoding section 1500 has a basic function as acoustic signal decoding apparatus. In this embodiment, since the configurations of acoustic signal receiving apparatus is the same as one illustrated in FIG. 4, except that a stereo decoding section 1500 is used. Thus, the description thereof will not be repeated here. In the following description, other structural components other than stereo decoding section 1500 are described using the same reference numerals as those illustrated in FIG. 4.

Stereo decoding section 1500 mainly includes demultiplexing section 1501, multiplying section 1502, deformed MDCT coefficient calculation section 1503, error MDCT coefficient decoding section 1504, and stereo MDCT coefficient decoding section 1505. Hereinafter, each configuration will be described in detail.

Demultiplexing section 1501 divides the stereo encoded data input from demultiplexing section 201 into balance parameter encoded data and error MDCT coefficient encoded data. Then, demultiplexing section 1501 outputs balance parameter encoded data to multiplying section 1502 and deformed MDCT coefficient calculation section 1503, while outputting error MDCT coefficient encoded data to error MDCT coefficient decoding section 1504. Demultiplexing section 1501 is not essential to this embodiment. Demultiplexing section 201 may separate balance parameter encoded data and error MDCT coefficient encoded data. Then Demultiplexing section 201 may directly output the balance parameter encoded data to multiplying section 1502 and deformed MDCT coefficient calculation section 1503, while directly outputting the error MDCT coefficient encoded data to error MDCT coefficient decoding section 1504.

In multiplying section 1502, Multiplier 1502*a* multiplies the decoded monaural MDCT coefficients (M'(k)) input from monaural decoding section 202 by the optimal balance parameter ($W_L(i_{opt})$) specified by the balance parameter encoded data input from demultiplexing section 1501. As a result, a multiplication result ($W_L(i_{opt})$ and M'(k)) an L-channel prediction signal) is acquired. Furthermore, in multiplying section 1502, multiplier 1502*b* multiplies the decoded monaural MDCT coefficients input from monaural decoding section 202 by the optimal balance parameter ($W_R(i_{opt})$) specified by the balance parameter encoded data input from demultiplexing section 1501. As a result, a multiplication result ($W_R(i_{opt})$ and M'(k)) (i.e. an R-channel prediction signal) is acquired. Then, multiplying section 1502 outputs each acquired prediction signal to deformed MDCT coefficient calculation section 1503.

By using the balance parameter encoded data input from demultiplexing section 1501 and the prediction signal input from multiplying section 1502, deformed MDCT coefficient calculation section 1503 outputs a prediction signal obtained by inverting the sign of one of the channels to stereo MDCT coefficient decoding section 1505. The details of the configuration of deformed MDCT coefficient calculation section 1503 are described later.

Using the error MDCT coefficient encoded data input from demultiplexing section 1501, error MDCT coefficient decoding section 1504 decodes L-channel error MDCT coefficients and outputs a decoding result ($E_L'(k)$) to stereo MDCT coefficient decoding section 1505. Using the error MDCT coefficient encoded data input from demultiplexing section 1501, error MDCT coefficient decoding section 1504 decodes R-channel error MDCT coefficients and outputs a decoding result (ER'(k)) to stereo MDCT coefficient decoding section 1505.

Stereo MDCT coefficient decoding section 1505 adds the L-channel error MDCT coefficients input from error MDCT coefficient decoding section 1504 to the prediction signal input from deformed MDCT coefficient calculation section 1503 to obtain L-channel decoded MDCT coefficients (L'(k)). The calculated L-channel decoded MDCT coefficients are output. Stereo MDCT coefficient decoding section 1505 adds the R-channel error MDCT coefficients input from error MDCT coefficient decoding section 1504 to the prediction signal input from deformed MDCT coefficient calculation section 1503 to obtain R-channel decoded MDCT coefficients (R'(k)). The calculated R-channel decoded MDCT coefficients are output.

Now, the description of the configuration of stereo decoding section 1500 is finished.

Figure 16:
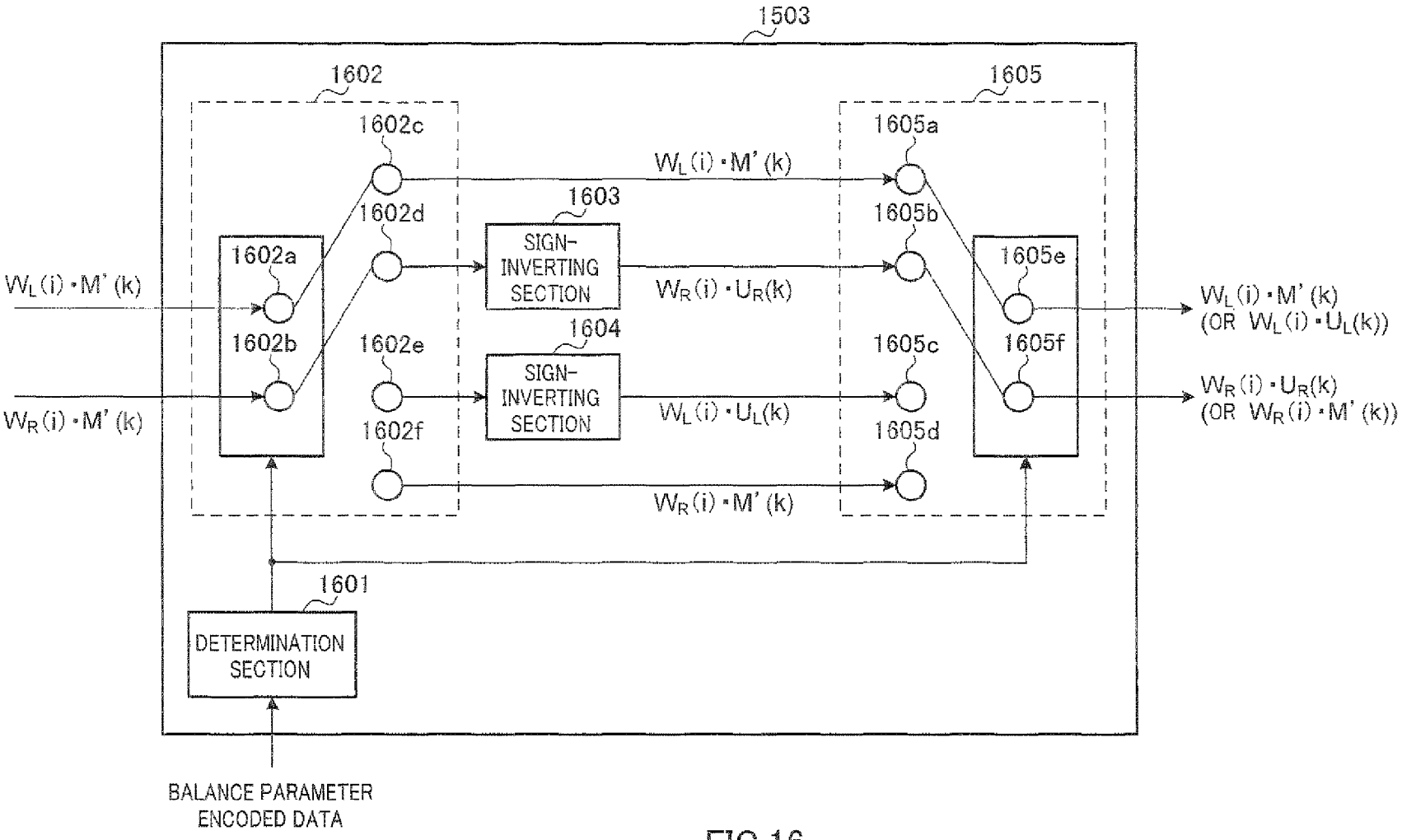
FIG. 16 is a block diagram illustrating the configuration of a deformed MDCT, coefficient calculation section according to Embodiment 4 of the present invention.

Next, the configuration of deformed MDCT coefficient calculation section 1503 is described with reference to FIG. 16. FIG. 16 is a block diagram illustrating the configuration of deformed MDCT coefficient calculation section 1503.

Deformed MDCT coefficient calculation section 1503 mainly includes determination section 1601, switching section 1602, sign-inverting section 1603, sign-inverting section 1604, and switching section 1605.

Determination section 1601 decodes the optimal balance parameter using the balance parameter encoded data input from demultiplexing section 1501. Then, determination section 1601 compares the balance parameter of L-channel with the balance parameter of R-channel, and outputs determination information representing the one having the smaller balance parameter between L-channel and R-channel to switching section 1602 and switching section 1605.

Switching section 1602 changes a signal line based on the determination information input from determination section 1601. Specifically, switching section 1602 connects switching terminal 1602*a* and switching terminal 1602*c* together when receiving an input of the determination information that the balance parameter of R-channel is smaller than the balance parameter of L-channel. Simultaneously, switching terminal 1602*b* and switching terminal 1602*d* are connected together. Therefore, switching section 1602 outputs the prediction signal ($W_L(i_{opt})$ and M'(k)) input from multiplier 1502*a* of multiplying section 1502 to switching section 1605. Simultaneously, the prediction signal ($W_R(i_{opt})$ and M'(k)) input from multiplier 1502*b* of multiplying section 1502 is output to sign-inverting section 1603. Specifically, switching section 1602 connects switching terminal 1602*a* and switching terminal 1602*e* together when receiving an input of the determination information that the balance parameter of L-channel is smaller than the balance parameter of R-channel. Simultaneously, switching terminal 1602*b* and switching terminal 1602*f* are connected together. Therefore, switching section 1602 outputs the prediction signal input from multiplier 1502*a* of multiplying section 1502 to switching section 1604. Simultaneously, the prediction signal input from the multiplier 1502*b* of the multiplying section 1502 is output to the switching section 1605.

Sign-inverting section 1603 inverts the sign of the prediction signal input from switching section 1602. Then, sign-inverting section 1603 outputs the multiplication result of the R-channel changing monaural MDCT coefficients and the optimal balance parameter ($W_R(i_{opt})$ and $U_R(k)$) (i.e. an R-channel prediction signal) to switching section 1605.

Sign-inverting section 1604 inverts the sign of the multiplication result input from switching section 1602. Then, sign-inverting section 1604 outputs the multiplication result of the L-channel changing monaural MDCT coefficients and the optimal balance parameter ($W_L(i_{opt})$ and $U_L(k)$) (i.e. an L-channel prediction signal) to switching section 1605.

Switching section 1605 connects switching terminal 1605*a* and switching terminal 1605*e* together when receiving an input of the determination information that the balance parameter of R-channel is smaller than the balance parameter of L-channel from determination section 1601. Simultaneously, switching terminal 1605*b* and 1605*f* of switching terminals are connected. Therefore, switching section 1605 outputs the multiplication result of the decoded monaural MDCT coefficients and the optimal balance parameter, which are input from switching section 1602, and the multiplication result of the R-channel changing monaural MDCT coefficients and the optimal balance parameter, which are input from sign-inverting section 1603, as prediction signals of L-channel and R-channel to stereo MDCT coefficient decoding section 1505, respectively. Switching section 1605 connects switching terminal 1605*c* and switching terminal 1605*e* together when receiving an input of the determination information that the balance parameter of L-channel is smaller than the balance parameter of R-channel from determination section 1601. Simultaneously, switching terminal 1605*d* and switching terminal 1605*f* are connected. Therefore, switching section 1605 outputs the multiplication result of the decoded monaural MDCT coefficients and the optimal balance parameter, which are input from switching section 1602, and the multiplication result of the L-channel changing monaural MDCT coefficients and the optimal balance parameter, which are input from sign-inverting section 1604, as prediction signals of R-channel and L-channel to stereo MDCT coefficient decoding section 1505, respectively.

Now, the description of the configuration of deformed MDCT coefficient calculation section 1503 is ended.

According to the present embodiment, in addition to the effects of Embodiment 1 as described above, a channel which is presumed that energy is large, or a channel which is presumed that an influence of a phase error is great, is selected by using a balance parameter. Thus, there is no need of transmitting determination data. Thus, prediction performance can be increased without an increase in additional information.

In each of the above embodiments, scaling may be performed so that the ratio of an L-channel signal and an R-channel signal may be approximate to 1 (one) in the case of a down mix. Thus, the information about a scaling coefficient may be included in multiplexed data and transmitted to an acoustic signal receiving apparatus. In each of the above embodiments, an input signal which an acoustic signal transmitting apparatus inputs or an output signal which an acoustic signal receiving apparatus outputs is applicable to apply any of voice signals and audio signals or a mixture thereof.

In each of the above embodiments, the L-channel is described as a left channel and the R-channel is described as a right channel. However, the present invention is not limited to these examples. In other words, the present invention is also operable in the case of any two channels are used instead of the L-channel and the R-channel. Similar effects can be obtained.

Each of the above embodiments has been described using MDCT as a frequency domain transform method. However, the present invention is not limited to this. In other words, the present invention is operable even in the case of using any of other frequency domain transform methods. Specifically, the same effects will be obtained when a frequency domain transform method sensitive to the difference in phase, for example, one using a discrete cosine transform (DCT), discrete sign conversion (DST), or the like, is used.

Although each of the above embodiment is configured to allow acoustic signal receiving apparatus 200 or 900 to receive multiplexed data output from acoustic signal transmitting apparatus 100, 700, or 800, the present invention is not limited to such a configuration. That is, even if it is not the multiplexed data generated in the configuration of any of acoustic signal transmitting apparatuses 100, 700, and 800, acoustic signal receiving apparatuses 200 and 900 are able decode any kind of multiplexed data as long as the data is generated from the acoustic signal transmitting apparatus capable of generating the multiplexed data having coding data required for decoding.

It is also possible to apply the acoustic signal encoding apparatus or acoustic signal decoding apparatus in each of the above embodiments to a base station apparatus or a terminal apparatus.

Also, although cases have been described with the above embodiment as examples where the present invention is configured by hardware, the present invention is by no means limited to this, and the present invention can also be realized by software. For example, the same functions as those of the acoustic signal encoding apparatus, acoustic signal decoding apparatus, or the like of the present invention can be realized by describing an algorithm of the present invention by a programming language and allowing the program to be stored in a memory and executed by means of information processing, such as a computer.

Each function block employed in the description of each of the aforementioned embodiments may typically be implemented as an LSI constituted by an integrated circuit. These may be individual chips or partially or totally contained on a single chip. "LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosure of Japanese Patent Application No. 2009-44806, filed on Feb. 26, 2009, including the specification, drawings and abstract, is incorporated herein by reference in its entirety.

INDUSTRIAL APPLICABILITY

The channel signal generation apparatus, acoustic signal encoding apparatus, acoustic signal decoding apparatus, acoustic signal encoding method, and acoustic signal decoding method of the present invention are suitable to generate an L-channel signal and an R-channel signal especially using a monaural signal.

The invention claimed is:

1. A channel signal generation apparatus for generating a frequency domain first channel signal for a first channel and a frequency domain second channel signal for a second channel by using a frequency domain monaural signal generated by using a first stereo signal for the first channel and a second stereo signal for the second channel, which constitute an acoustic signal, the channel signal generation apparatus comprising:

a monaural encoder structured to generate a monaural signal from the first stereo signal and the second stereo signal and to generate the frequency domain monaural signal from the monaural signal; and a generator structured to receive the frequency domain monaural signal from said monaural encoder and to generate the frequency first channel signal and the frequency domain second channel signal by performing change processing on the frequency domain monaural signal, where the change processing compensates for the phase difference between the first stereo signal and the second stereo signal in accordance with input determination data, wherein the generator performs the change process by storing a plurality of previously defined modified matrices, selecting one modified matrix from the plurality of modified matrices in accordance with phase data about the phase difference, which is input as the determination data, and performing arithmetic operation on the frequency domain monaural signal and the selected modified matrix.

2. A channel signal generation apparatus for generating a frequency domain first channel signal for a first channel and a frequency domain second channel signal for a second channel by using a frequency domain monaural signal generated by using a first stereo signal for the first channel and a second stereo signal for the second channel, which constitute an acoustic signal, the channel signal generation apparatus comprising:

a monaural encoder structured to generate a monaural signal from the first stereo signal and the second stereo signal and to generate the frequency domain monaural signal from the monaural signal; and a generator structured to receive the frequency domain monaural signal from said monaural encoder and to generate the frequency domain first channel signal and the frequency domain second channel signal by performing change processing on the frequency domain monaural signal, where the change processing compensates for the phase difference between the first stereo signal and the second stereo signal in accordance with input determination data, wherein the generator performs the change process by, in accordance with a result of making a comparison between an energy of the frequency domain first stereo signal for the first channel and an energy of the frequency domain second stereo signal for the second channel, which are input as the determination data, using one of the frequency domain first channel signal and the frequency domain second channel signal as the frequency domain monaural signal, and using the other one of the frequency domain first channel signal and the frequency domain second channel signal as a signal obtained by inversion of a sign of the frequency domain monaural signal.

3. The channel signal generation apparatus according to claim 2, wherein the generator performs the change process by, when the result of the comparison is that the energy of the frequency domain second stereo signal is smaller than the energy of the frequency domain first stereo signal and the result is input into the determination data, using the frequency domain monaural signal as the frequency domain first channel signal and a signal obtained by inversion of a sign of the frequency domain monaural signal as the frequency domain second channel signal.

4. The channel signal generation apparatus according to claim 2, wherein the generator performs the change processing for every subband in accordance with a result of the comparison every previously defined subband.

5. The channel signal generation apparatus according to claim 4, wherein the generator calculates the energy of the frequency domain monaural signal for every subband, selects a predetermined number of subbands where the energy of the frequency domain monaural signal is higher than a predetermined value, and performs the change processing on the selected subband.

6. An acoustic signal encoding apparatus for generating a stereo encoded data using a frequency domain monaural signal generated by using a first stereo signal for a first channel and a second stereo signal for a second channel, the acoustic signal encoding apparatus comprising:

(a) a channel signal generation apparatus for generating a frequency domain first channel signal for a first channel and a frequency domain second channel signal for a second channel by using a frequency domain monaural signal generated by using a first stereo signal for the first channel and a second stereo signal for the second channel, which constitute an acoustic signal, the channel signal generation apparatus comprising:

a monaural encoder structured to generate a monaural signal from the first stereo signal and the second stereo signal and to generate the frequency domain monaural signal from the monaural signal; and a generator structured to receive the frequency domain monaural signal from said monaural encoder and to generate the frequency domain first channel signal and the frequency domain second channel signal by performing change processing on the frequency domain monaural signal, where the change processing compensates for the phase difference between the first stereo signal and the second stereo signal in accordance with input determination data;

(b) a predictor structured to perform prediction processing using the frequency domain first channel signal and the frequency domain second channel signal, which are generated by the channel signal generation apparatus, to generate a first channel prediction candidate signal for the first channel and a second channel prediction candidate signal for the second channel; and (b) an encoder structured to select one from a plurality of first channel prediction candidate signals and determine the selected one as a first channel prediction signal, select one from a plurality of second channel prediction candidate signals and determines the selected one as a second channel prediction signal, and perforin encoding using a first error signal, which is an error between the first channel prediction signal and a frequency domain first stereo signal generated by frequency domain transform of the first stereo signal, and a second error signal, which is an error between the second channel prediction signal and a frequency domain second stereo signal generated by frequency domain transform of the second stereo signal.

7. The acoustic signal encoding apparatus according to claim 6, wherein the encoder determines, from a plurality of first channel prediction candidate signals and a plurality of second channel prediction candidate signals, the first channel prediction candidate signal and the second channel prediction candidate signal by which a sum of an error between the frequency region first stereo signal and the first channel prediction candidate signal and an error between the frequency domain second stereo signal and the second channel prediction candidate signal is the minimum as the first channel prediction signal and the second channel prediction signal, respectively.

8. An acoustic signal encoding apparatus for generating a stereo encoded data using a frequency domain monaural signal generated by using a first stereo signal for a first channel and a second stereo signal for a second channel, comprising:

(a) a predictor structured to subject the frequency domain monaural signal to prediction processing using a first balance parameter candidate of the first channel and a second balance parameter candidate of the second channel to generate a first channel prediction candidate signal of the first channel and a second channel prediction candidate signal;

(b) a channel signal generation apparatus for generating a frequency domain first channel signal for a first channel and a frequency domain second channel signal for a second channel by using a frequency domain monaural signal generated by using a first stereo signal for the first channel and a second stereo signal for the second channel, which constitute an acoustic signal, the channel signal generation apparatus comprising:

a monaural encoder structured to generate a monaural signal from the first stereo signal and the second stereo signal and to generate the frequency domain monaural signal from the monaural signal; and a generator structured to receive the frequency domain monaural signal from said monaural encoder and to generate the frequency domain first channel signal and the frequency domain second channel signal by performing change processing on the frequency domain monaural signal, where the change processing compensates for the phase difference between the first stereo signal and the second stereo signal in accordance with input determination data; and (c) an encoder structured to perform encoding using a first error signal and a second error signal, where the first error signal is an error between a frequency domain first stereo signal generated by performing frequency domain transform of the first stereo signal and the frequency domain first channel signal, and the second error signal is an error between a frequency domain second stereo signal generated by performing frequency domain transform of the second stereo signal and the frequency domain second channel signal.

9. The acoustic signal encoding apparatus according to claim 8, wherein the encoder determines, from a plurality of first channel prediction candidate signals and a plurality of second channel prediction candidate signals, the first channel prediction candidate signal and the second channel prediction candidate signal, by which a sum of an error between the frequency region first stereo signal and the first channel prediction candidate signal and an error between the frequency domain second stereo signal and the second channel prediction candidate signal is the minimum, are determined as a first channel prediction signal and a second channel prediction signal, respectively.

10. An acoustic signal encoding method for generating a stereo encoded data using a frequency domain monaural signal generated by using a first stereo signal for a first channel and a second stereo signal for a second channel, the acoustic signal encoding comprising:

a generation step of generating a frequency domain first channel signal and a frequency domain second channel signal by performing change processing on the frequency domain monaural signal, where the change processing compensates for the phase difference between the first stereo signal and the second stereo signal in accordance with input determination data;

a prediction step of performing prediction processing using the frequency domain first channel signal and the frequency domain second channel signal to generate a first channel prediction candidate signal for the first channel and a second channel prediction candidate signal for the second channel; and an encoding step of selecting one from a plurality of first channel prediction candidate signals and determining the selected one as a first channel prediction signal, selecting one from a plurality of second channel prediction candidate signals and determining the selected one as a second channel prediction signal, performing encoding using a first error signal and a second error signal, where the first error signal is an error between the first channel prediction signal and a frequency domain first stereo signal generated by frequency domain transform of the first stereo signal, and a second error signal is an error between the second channel prediction signal and a frequency domain second stereo signal generated by frequency domain transform of the second stereo signal.

11. A method for decoding acoustic signal by receiving stereo encoded data generated by encoding with a frequency domain first monaural signal generated by a first stereo signal for a first channel and a second stereo signal for a second channel in an acoustic signal decoding apparatus, the method comprising:

a receiving step of taking out and outputting a balance parameter encoded data from the stereo encoded data;

a generation step of generating a frequency domain first channel signal and a frequency domain second channel signal by performing change processing on a frequency domain second monaural signal, where the change processing compensates for the phase difference between the first stereo signal and the second stereo signal in accordance with input determination data;

a prediction step of performing prediction processing for applying a balance parameter obtained by using the balance parameter encoded data to the frequency domain first channel signal and the frequency domain second channel signal to generate a first prediction signal of the first channel and a second channel prediction signal of the second channel; and a decoding step of performing decoding using the first channel prediction signal and the second channel prediction signal.

* * * * *